United States Patent [19]

Greskovics et al.

[11] Patent Number: 4,558,479

[45] Date of Patent: Dec. 17, 1985

[54] POOL CLEANER

[75] Inventors: Paul Greskovics, Manhattan Beach; Donald R. Chivens, Northridge, both of Calif.

[73] Assignee: Alopex Industries, Inc., San Marcos, Calif.

[21] Appl. No.: 574,293

[22] Filed: Jan. 26, 1984

[51] Int. Cl.[4] ..... E04H 3/20

[52] U.S. Cl. ..... 15/1.7; 55/374; 56/202; 180/7.1; 180/7.3

[58] Field of Search ..... 15/1.7, 347, 340; 285/319, DIG. 22; 56/202; 55/374, 376–379, 507; 210/169; 180/7.1, 7.3

[56] References Cited

U.S. PATENT DOCUMENTS

| | | | |
|---|---|---|---|
| 839,297 | 12/1906 | Kennedy et al. | 285/319 X |
| 3,032,044 | 5/1962 | Pansini . | |
| 3,295,540 | 1/1967 | Ortega . | |
| 3,392,738 | 7/1968 | Pansini . | |
| 3,689,408 | 9/1972 | Edmiston et al. | 15/1.7 |
| 3,822,754 | 7/1974 | Henkin et al. | 15/1.7 |
| 3,870,491 | 3/1975 | Friesen et al. | 55/376 |
| 3,921,654 | 11/1975 | Pansini . | |
| 3,936,899 | 2/1976 | Henkin | 15/1.7 |
| 3,972,339 | 8/1976 | Henkin | 15/1.7 |
| 4,007,749 | 2/1977 | Pansini . | |
| 4,086,933 | 5/1978 | Pansini . | |
| 4,168,557 | 9/1979 | Rasch et al. . | |
| 4,240,173 | 12/1980 | Sherrill | 15/1.7 |

*Primary Examiner*—Edward L. Roberts

*Attorney, Agent, or Firm*—Fulwider, Patton, Rieber, Lee & Utecht

[57] ABSTRACT

An improved pool cleaner is provided of the type for submerged random travel generally along the floor and sidewalls of a swimming pool to dislodge and collect debris. The pool cleaner comprises an hydraulically contoured housing consisting of a limited number of shell shaped housing portions designed for rapid assembly about an integrated drive assembly having a water-powered drive train encased within the housing and rotatable wheels outside the housing for supporting and driving the pool cleaner. Water under pressure is supplied through a water supply mast detachably mounted on the housing for flow into a pressure manifold from which individual water flows are coupled through appropriately sized nozzles to drive a water turbine of the drive train and through a plurality of jet pump orifices opening generally upwardly about the inner diameter of an open central suction mast through which debris is drawn upwardly into a collection bag. In addition, water from the pressure manifold may be directed through a rearwardly open thrust jet positioned for improved cleaner stability and a rearwardly open sweep hose jet coupled to a flexible sweep hose. A back up valve assembly is mounted within the housing and includes an hydraulic timer responsive to a small bleed flow from the supply mast to periodically divert the pressurized water inflow to a back up jet oriented to drive the cleaner rearwardly and/or upwardly for a short time interval thereby preventing entrapment of the cleaner in a confined region of the pool such as a corner.

61 Claims, 19 Drawing Figures

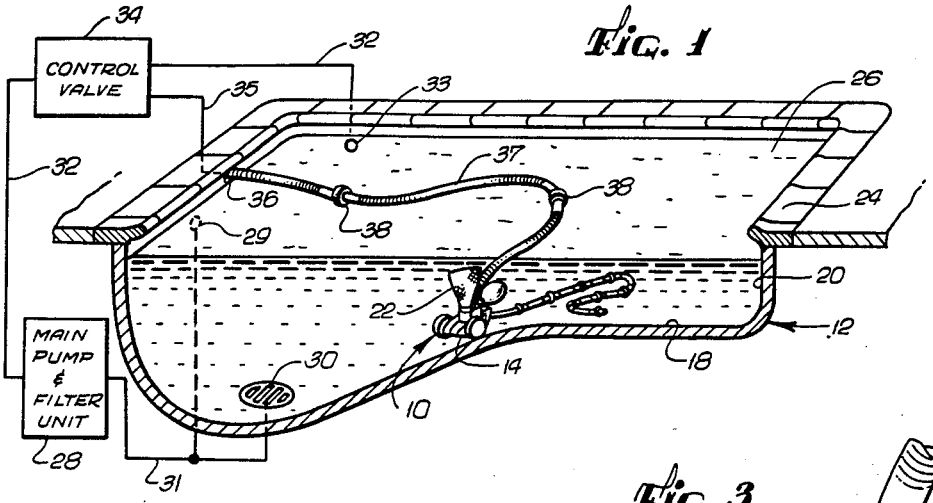
Fig. 1
Fig. 2
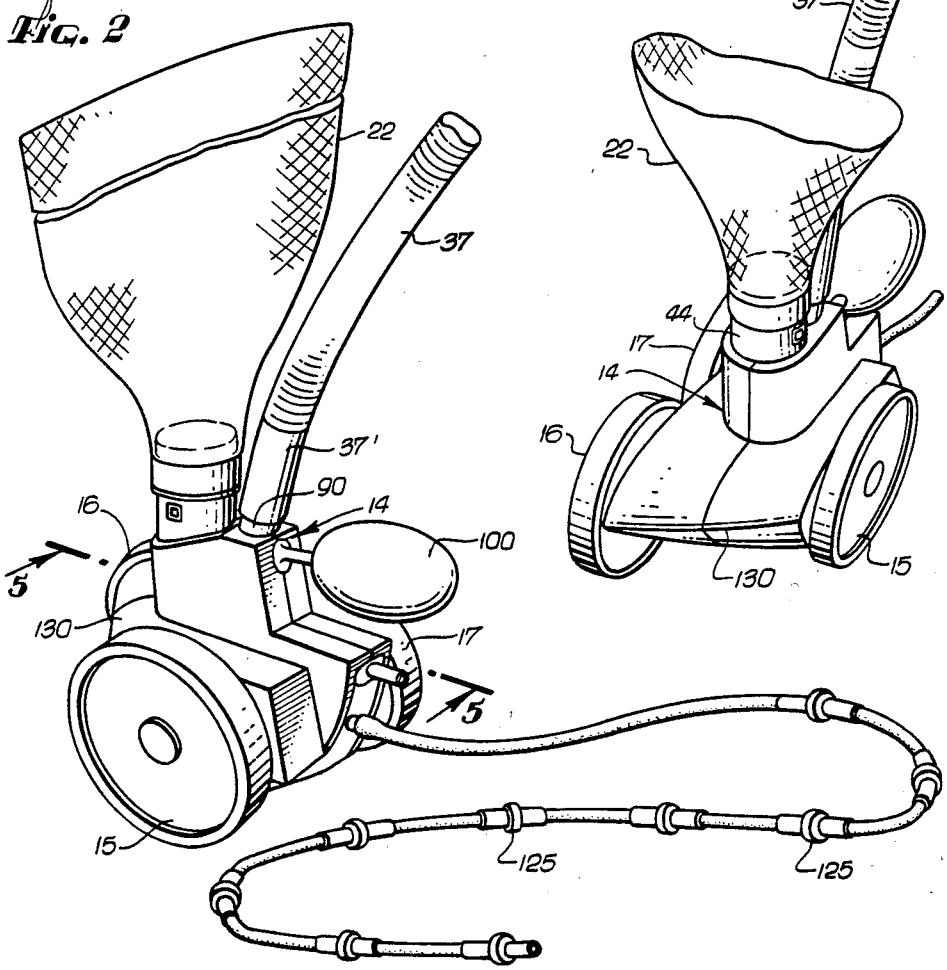
Fig. 3
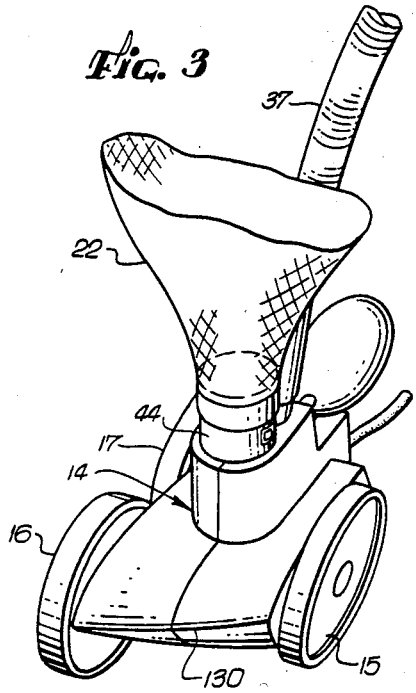

POOL CLEANER

BACKGROUND OF THE INVENTION

This invention relates generally to devices for dislodging and/or collecting debris within a swimming pool. More specifically, this invention relates to an improved pool cleaner of the type for submerged and generally random travel along the floor and sidewalls of a swimming pool to dislodge and collect debris.

Residential and commercial swimming pools conventionally include a water filtration system for removing dirt and debris from the pool water. Such filtration systems typically include a circulation pump installed at a convenient position outside the swimming pool and appropriately coupled through piping to the pool water for pumping water to a filter unit. The filter unit includes a filtration material for separating from the water dirt and other suspended debris, after which the water is recirculated by the pump to the swimming pool. To maintain desired standards of water cleanliness and clarity, the filtration system is normally operated on a daily schedule for at least several hours each day.

While a swimming pool filtration system of the type described above is essential for maintaining water cleanliness and clarity, such filtration systems by themselves are generally incapable of maintaining a swimming pool in a satisfactory state of cleanliness over a long period of time. For example, conventional water filtration systems are designed for removing suspended, water-entrained debris of a relatively small size and not for removing sizeable debris, such as leaves or the like, of a larger size. Moreover, conventional systems are not designed for removing particulate matter which tends to settle irrespective of size onto the floor or sidewalls of the swimming pool. Accordingly, periodic cleaning of the pool floor and sidewalls by additional means is required for maintaining the swimming pool in a clean condition.

A variety of in-the-pool cleaning devices are well known for use in concert with a conventional filtration system for cleaning the floor and sidewalls of a swimming pool. One such particularly common device comprises, for example, a so-called vacuum head which is connected to the suction side of a pool filtration system pump and then moved manually over submerged pool surfaces to draw debris and sediment into the main filter unit. A major disadvantage of such manual devices, however, resides in the fact that the pool owner may be disinclined to spend the time or the effort to clean the pool himself or to incur the expense of hiring other persons to perform the cleaning task.

In recent years, a variety of automated in-the-pool cleaning devices have become popular for removing or assisting in the removal of debris and sediment from swimming pool water without requiring manual operation or attention. For example, floating in-the-pool cleaning devices of the general type shown and described in U.S. Pat. No. 3,032,044 have been designed for connection to the circulation pump of a pool water filtration system for directing a portion of the pump discharge in the form of one or more pressurized water jets against pool surfaces to dislodge debris and sediment. The dislodged material is thus returned to a suspended state within the pool water for removal by the conventional filtration system, thereby improving the overall cleanliness of the pool water. However, larger debris tends to resettle relatively quickly onto the pool floor and sidewalls resulting in a periodic requirement to remove such debris by other techniques, such as a manually handled vacuum head.

Other widely used in-the-pool cleaning devices have been designed for collecting large and small debris from a swimming pool while simultaneously dislodging small particulate and sediment from the pool floor and sidewalls. See, for example, the pool cleaning device shown and described in U.S. Pat. No. 3,822,754 depicting a cleaning device adapted for submerged and generally random travel along the pool floor and sidewalls for dislodging and collecting debris, wherein such devices are exemplified by the pool cleaner manufactured and sold by Polaris Vac-Sweep of San Marcos, Calif., under the trademark "Polaris Vac-Sweep". This latter type of automatic in-the-pool cleaning device advantageously provides improved overall pool cleaning by substantially precluding any requirement to periodically utilize a manually operated vacuum head to remove larger debris such as leaves from a swimming pool.

While submerged pool cleaning devices of the type described in U.S. Pat. No. 3,822,754 have performed in a highly satisfactory manner, particularly in comparison with other types of cleaning devices, a number of operational shortcomings are present in currently available equipment. For example, such cleaning devices are typically supported upon driven wheels wherein at least a portion of a wheel drive train is exposed to potential jamming or damage from contact with pool debris. In addition, such devices have had relatively high pressure requirements for proper operation, wherein the pressure requirement has been fulfilled in many systems only by use of a separate booster pump in addition to the filtration system pump. In addition, by way of further example, satisfactory apparatus has not been provided for integration directly into the cleaning device to prevent device entrapment within a confined region of a pool, such as a corner.

There exists, therefore, a significant need for an improved in-the-pool cleaning device of the type adapted for submerged travel over pool surfaces to collect and dislodge debris, wherein drive train components are protected against contact with pool debris, wherein water flow and pressure requirements for proper efficient operation are substantially minimized, and wherein effective backup means are provided for preventing undesired entrapment of the device within a confined region of a pool. The present invention fulfills these needs and provides further significant related advantages.

SUMMARY OF THE INVENTION

In accordance with the invention, an improved pool cleaner is provided for submerged and generally random travel over the floor and sidewalls of a swimming pool to collect debris and to dislodge and suspend debris within the pool water for subsequent filtration by a main pool filtration system. The pool cleaner comprises a hydraulically contoured housing of simplified design and improved hydraulic shape driven throughout the pool by an integrated drive assembly including a water-powered drive train protectively encased within the housing and a plurality of wheels disposed outside the housing. The pool cleaner is adapted for connection to a supply of water under pressure via a flexible supply hose. The pool cleaner includes improved water flow distribution means for utilizing the pressurized water as a power source for the drive train, for providing a debris suction collection system, and for improving pool cleaner stability and capability to dislodge debris from pool surfaces.

In the preferred form of the invention, the pool cleaner housing is defined by a relatively small number of shell-shaped housing portions designed for rapid assembly about the integrated drive assembly to substantially encase and protect the drive assembly in a seated operational position with rotatable wheels disposed outside the housing for supporting and driving the cleaner. The water supply hose is coupled to a supply mast having a lower end detachably mounted on the housing and an upper end angled slightly in a rearward direction for connection to the hose. The supply mast couples the pressurized water inflow to a pressure manifold within the housing from which the pressurized water is distributed in controlled ratio to the various operational components of the pool cleaner.

More particularly, one or more drive nozzles direct a portion of the water from the pressure manifold into driving relation with a water turbine of the drive train. The water turbine is coupled through reduction gears to a central drive shaft carrying a driving sprocket which is in turn coupled via timing belts to a pair of driven sprockets within the housing. The driven sprockets are each disposed at a common side of the housing and are drivingly coupled to a respective one of two cleaner wheels disposed outside the cleaner housing. Axially spaced pairs of bearings on each axle rotatably support the driven sprockts and the associated cleaner wheel. A third cleaner wheel is driven directly by the drive shaft at the opposite side of the housing, wherein the axis of rotation of this third wheel is offset relative to the two cleaner wheels associated with the driven sprockets.

The housing includes a vertically open suction mast having a porous debris-collecting filter bag mounted at its upper end by means of spring-loaded latch clips. The lower end of the suction mast is open at the bottom of the housing, and a plurality of relatively small jet pump orifices are arranged about the inner diameter of the suction mast generally at the lower end thereof. These jet pump orifices direct individual water flows from the pressure manifold upwardly and slightly radially inwardly within the suction mast thereby creating a suction water flow upwardly through the mast drawing debris from beneath the cleaner housing into the collection filter bag. The bottom profile of the housing is contoured particularly with respect to providing an increased distance between the housing and pool surfaces behind the suction mast to improve cleaner traction and thereby correspondingly improve suction cleaning capability particularly when the water supply pressure is relatively low.

The back up valve assembly is mounted within the housing and includes a primary flow tube aligned between the water supply mast and the pressure manifold. A small bleed port formed along the primary flow tube passes a small bleed flow of water perpendicular to the general water flow through the primary flow tube, wherein the bleed flow is directed into driving relation with a water wheel forming a portion of an hydraulic timer. The water wheel is rotatably driven by the bleed flow to drive a reduction gear train which correspondingly drives a Geneva wheel mechanism for switching a back up valve plate associated with the primary flow tube between a normal position closing a back up jet port and permitting primary water flow to the pressure manifold, and a back up position at least substantially closing primary flow to the manifold and opening the back up jet for a short time interval. This back up jet directs the water flow generally downwardly and/or generally forwardly beneath the cleaner housing to lift the entire cleaner in an upward and/or rearward direction thereby preventing the cleaner from becoming stuck in a confined region of the pool, after which the valve plate returns to its normal position and the cleaner resumes normal operation.

According to further aspects of the invention, additional water flows from the pressure manifold are directed to a rearwardly open thrust jet and a rearwardly open sweep hose jet spaced vertically beneath the thrust jet. The thrust jet creates a reaction force acting forwardly on the cleaner along a plane positioned above the rotational axes of the cleaner drive wheels to assist forward cleaner motion and to increase downward traction particularly on the front wheel. The sweep hose port is coupled to an elongated flexible sweep hose which is pulled by the cleaner through the pool, wherein the sweep hose reacts to water flow therethrough to whip about in a generally random fashion dislodging debris from pool surfaces. In addition, water discharged by the drive train water turbine and the back up valve water wheel is guided into the interior of the housing in sufficient volume relative to housing openings in the vicinity of the wheels and the supply and suction masts to create a slight internal housing pressurization tending to prevent ingress of debris or other foreign matter which might otherwise interfere with cleaner operation.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a somewhat schematic perspective view illustrating an improved pool cleaner embodying the novel features of the invention and shown in operation traveling generally along the floor of a swimming pool;

FIG. 2 is an enlarged generally rear perspective view of the pool cleaner of FIG. 1;

FIG. 3 is an enlarged generally front perspective view of the pool cleaner shown in FIG. 1;

DETAILED DESCRIPTION OF THE PREFERRED EMBODIMENT

Figure 4:
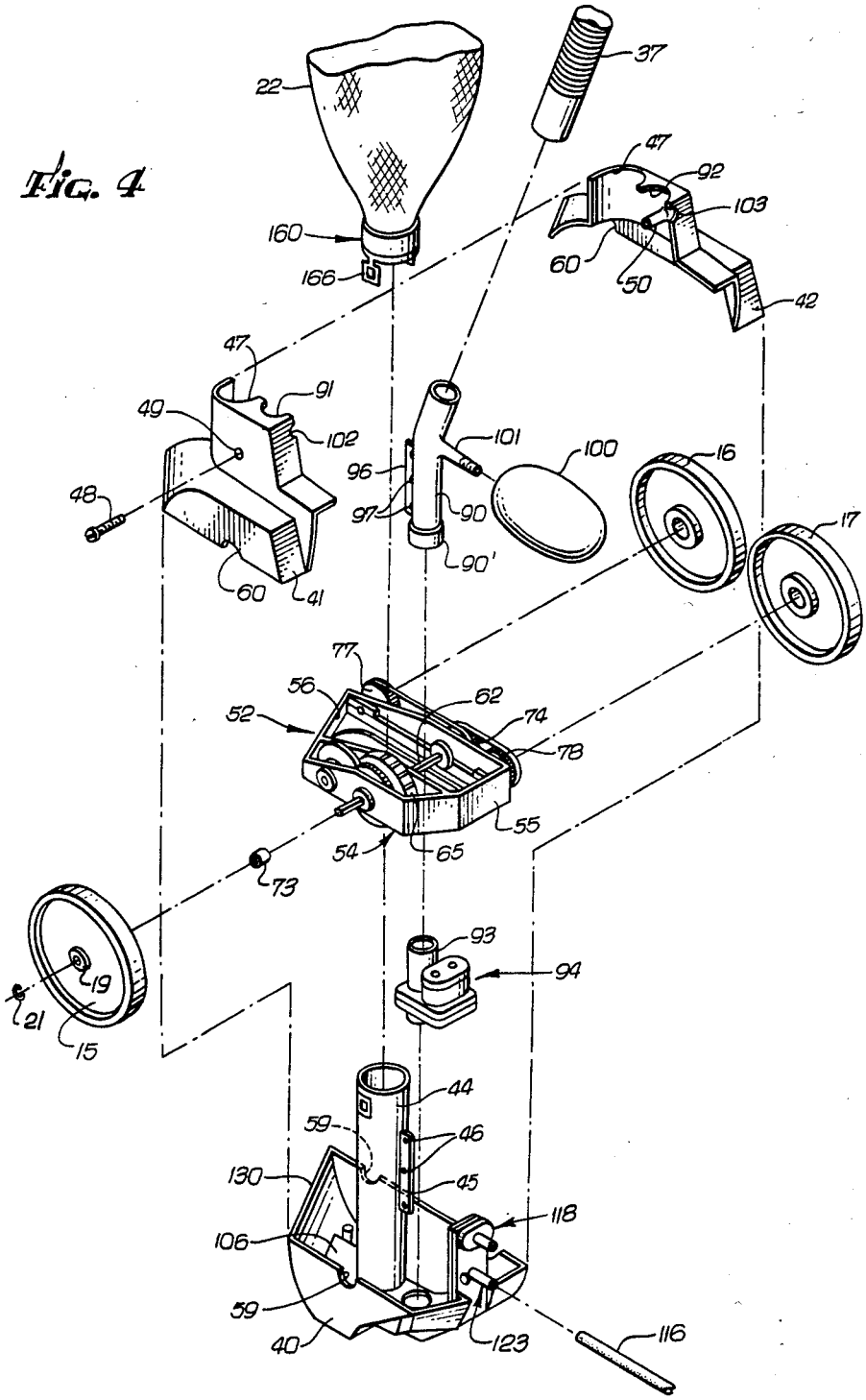
FIG. 4 is an exploded perspective view illustrating assembly of the major components of the improved pool cleaner.

As shown in the exemplary drawings, an improved automatic swimming pool cleaner referred to generally by the reference numeral 10 is provided for dislodging and/or collecting debris and sediment from within a swimming pool 12. The pool cleaner 10 comprises a simplified, hydraulically contoured housing 14 formed from generally shell-shaped housing portions adapted for rapid assembly about an hydraulically operated drive assembly including an integrated drive train (not shown in FIG. 1) encased within the housing and a plurality of wheels 15, 16, and 17 for supporting and driving the cleaner over the floor 18 and sidewalls 20 of the swimming pool 12. In addition, the pool cleaner 10 includes an improved hydraulic vacuum system for drawing debris and sediment into a porous collection bag 22, and a back up valve assembly having an hydraulic timer (also not shown in FIG. 1) is mounted within the housing for periodically altering the direction of cleaner travel to prevent entrapment within a confined region or corner of the swimming pool.

The automatic swimming pool cleaner 10 of the present invention constitutes an improvement upon swimming pool cleaners of the general type described in U.S. Pat. No. 3,822,754, wherein such cleaners are designed for generally random travel over the floor 18 and sidewalls 20 of a swimming pool 12 having virtually any conventional construction. More particularly, as depicted by way of example in FIG. 1, such swimming pools 12 commonly include the pool floor 18 which may be generally horizontal or of sloping contour to define comparatively shallower and deeper regions of the pool. The pool floor 18 blends generally smoothly with sidewalls 20 which extend upwardly to appropriate decking 24 or the like above the surface of water 26 filling the pool.

A swimming pool 12 of this general type is typically provided with a filtration system 28 depicted schematically in FIG. 1 for filtering particulate and other foreign matter from the pool water 26 to maintain the water in a relatively clear and sanitary state. This filtration system is normally installed at a convenient location near the swimming pool and includes a circulation pump for drawing water from the pool through one or more outflow ports 29 and/or floor drains 30 for passage through appropriate conduits 31 and further through a filter unit which separates particulate from the pool water. The filtered pool water is coupled from the filter unit through a return conduit 32 for recirculation to the pool via one or more return ports 33 typically positioned slightly below the surface of the pool water.

The pool cleaner 10 of the present invention is hydraulically operated to travel back and forth in a generally random pattern over the pool floor 18 and to climb the sidewalls 20 for collection of debris, sediment, and the like within the collection bag 22, wherein this foreign matter may have settled onto the surfaces of the pool floor and sidewalls. In addition, the pool cleaner 10 includes means for disturbing and dislodging settled debris and sediment for suspension thereof within the pool water for flow into and filtration within the main filtration system 28. Accordingly, the pool cleaner 10 collects debris, such as leaves, twigs, and the like, which generally will not flow through the circulation system 28, and functions further to maintain smaller debris and particulate in suspension with the water for improving the overall cleaning effectiveness of the circulation system. In addition, the cleaner tends to circulate and distribute pool chemicals, such as chlorine, substantially uniformly throughout the pool, wherein such chemicals are heavier than water and otherwise tend to settle with higher concentration at or near the bottom of the pool. Advantageously, the pool cleaner 10 operates automatically and substantially unattended, requiring only occasional emptying of the debris collection bag 22.

The hydraulic drive assembly and vacuum system of the pool cleaner 10 are powered by a supply of water under pressure obtained conveniently and directly from the main filtration system 28 of the swimming pool. More particularly, a control valve 34 is installed along the length of the filtered water return conduit 32 for diverting all or part of the filtered water discharged from the filter unit for passage through an auxiliary conduit 35 to a cleaner supply port 36 at one side of the pool 12. An elongated flexible hose 37 of a lightweight plastic material or the like has one end adapted for connection to this supply port 36 and an opposite or downstream end connected to the pool cleaner 10 for coupling the pressurized filtered water to the pool cleaner for water-powered operation of the various cleaner components, as will be described. The length of the flexible hose 37 is chosen to permit travel of the pool cleaner 10 over substantially the entire submerged surface area of the pool floor 18 and sidewalls 20 with one or more swivel joints 38 being conveniently provided along the length of the hose to relieve and accommodate hose twisting or kinking which might otherwise occur in response to random cleaner travel and result in undesired restriction or interference with cleaner operation.

The pool cleaner 10 of the present invention provides a number of significant improvements in overall operation and cleaning efficiency in comparison with previously available automatic pool cleaners of the same general type. More particularly, the improved pool cleaner 10 is designed for reliable and effective operation in response to a water supply flow having a relatively reduced pressure particularly in comparison with previous cleaners of the type requiring use of a separate booster pump, thereby reducing cleaner energy consumption and further permitting a relatively high water flow to be maintained through the normal return conduit 32 of the filtration system 28 throughout cleaner operation. As a result, the filtration system 28 operates with a highly satisfactory cleaning effectiveness simultaneously with operation of the pool cleaner 10 to improve substantially the overall state of cleanliness of the swimming pool, all without requiring operator attention or intervention. In addition, the improved pool cleaner 10 is provided with a simplified housing 14 designed for rapid assembly encasing an integrated drive train with moving components protected against contact with debris or any sizable foreign matter to prevent drive train jamming or malfunction.

Figure 5:
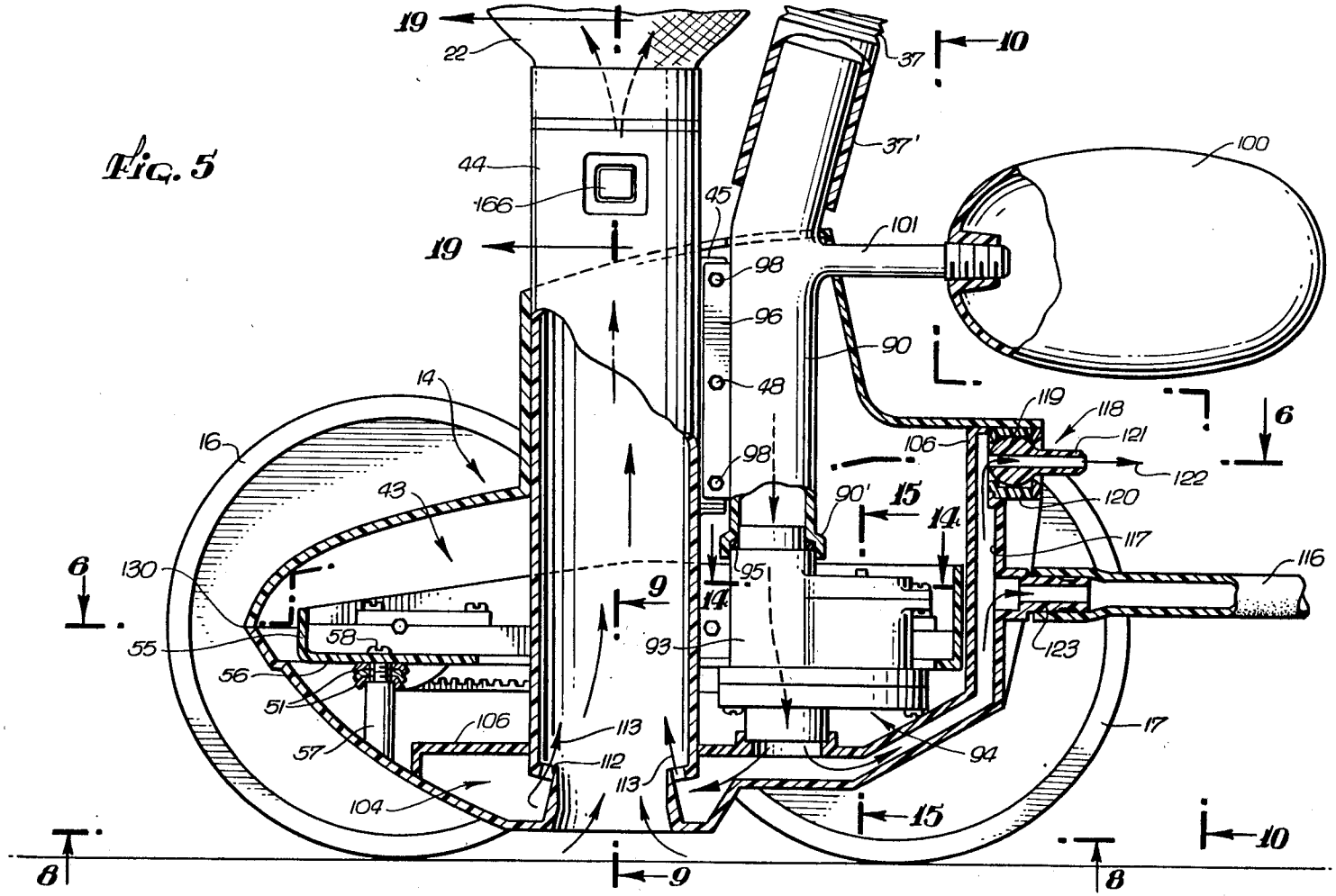
FIG. 5 is an enlarged fragmented longitudinal vertical section of the improved pool cleaner, taken generally on the line 5—5 of FIG. 2.

As shown in more detail in one preferred form in FIGS. 2–5, the pool cleaner 10 comprises the hydraulically contoured housing 14 formed from a relatively minimum number of generally shell-shaped housing portions preferably of a lightweight and inexpensive molded plastic construction. These shell-shaped housing portions include a lower housing base 40 adapted for rapid assembly with and attachment to upper left and right cowlings 41 and 42 to define a substantially enclosed housing chamber 43 (FIG. 5).

The housing base 40 is generally upwardly open in configuration and includes a central integrally molded and upstanding open cylindrical suction mast 44 forming a portion of the hydraulic vacuum system to be described in more detail. A thin mounting bracket 45 extends vertically along the rear side of the suction mast and includes a plurality of vertically spaced openings 46. The two upper cowlings 41 and 42 are shaped for transverse mating engagement defining a generally downwardly open configuration to fit over and conform with the housing base 40. These upper cowlings 41 and 42 include transversely aligned semicircular recesses 47 which cooperate to form a circular passage fitting closely about the upstanding suction mast 44 at a position slightly above the mounting bracket 45. A screw 48 has a stem threaded shank received through an appropriately sized opening 49 in the left cowling 41 and further through one of the mounting bracket openings 46 for secured threaded reception into an aligned apertured boss 50 on the inboard side of the right cowling 42 to attach the cowlings together and further to mount those cowlings securely about the suction mast 44 and with respect to the housing base 40.

The cleaner housing 14, when assembled, encases an integrated drive train 52 (FIG. 4) within the housing chamber 43, wherein this drive train 52 is advantageously preassembled with the cleaner wheels 15, 16, and 17 to form the hydraulic drive assembly from the cleaner and form a rapid, simplified installation into the housing as a preassembled unit. This integrated drive train 52 is shown in more detail in FIGS. 5, 6, and 11–13. As illustrated, the drive train comprises a lightweight support frame 54 of molded plastic construction having an array of five vertical walls 55 for rotatably supporting various drive train power transfer components. The vertical walls 55 of the support frame 54 are joined to a lower generally horizontal shelf 56 which fits in nested relation in a predetermined position onto a pair of apertured bosses 57 projecting upwardly from within the housing base 40. A mounting screw 58 and a fastened lower washer 59 through appropriate holes in the support frame shelf 56 for threaded reception into the bosses 57 to secure the drive train 52 within the housing base 40.

According to one feature of the invention, the upper end of the apertured bosses 57 are adapted to carry a number of inverted cup-shaped spacers 51 between the bosses and the support frame 54, as shown best in FIG. 5. These spacers 51 can be defined in place or removed in an appropriate number, as desired, to control the spacing of the the height of the cleaner wheels 15, 16, and 17 carried by the drive train 52 with respect to the cleaner housing base 40, and thereby control the spacing of the suction mast 44 relative to an underlying pool surface. Variability of this mast-pool surface spacing advantageously permits the suction characteristics of the hydraulic vacuum system, to be described, to be customized quickly and easily to a particular pool. While the spacers 51 are shown in cup-shaped form, alternative spacer designs are contemplated including, for example, indicia or scores on the bosses indicating incremental positions for shortening the bosses as desired to control suction mast spacing with respect to a pool surface.

In accordance with a further primary aspect of the present invention, the support frame 54 is sized and shaped to fit relatively closely within the assembled cleaner housing 14 whereas the cleaner wheels 15, 16, and 17 are supported by the frame 54 in positions outside the assembled housing for rolling contact with the surfaces of the pool floor 18 and sidewalls 20. In this regard, the housing base 40 has an upper peripheral margin including three upwardly opening semicircular recesses 59 which cooperate with three downwardly opening semicircular recesses 60 formed collectively in the upper cowlings 41 and 42 for relatively close clearance passage of appropriate axles coupled between the drive train 52 and the three cleaner wheels 15, 16, and 17.

Figure 6:
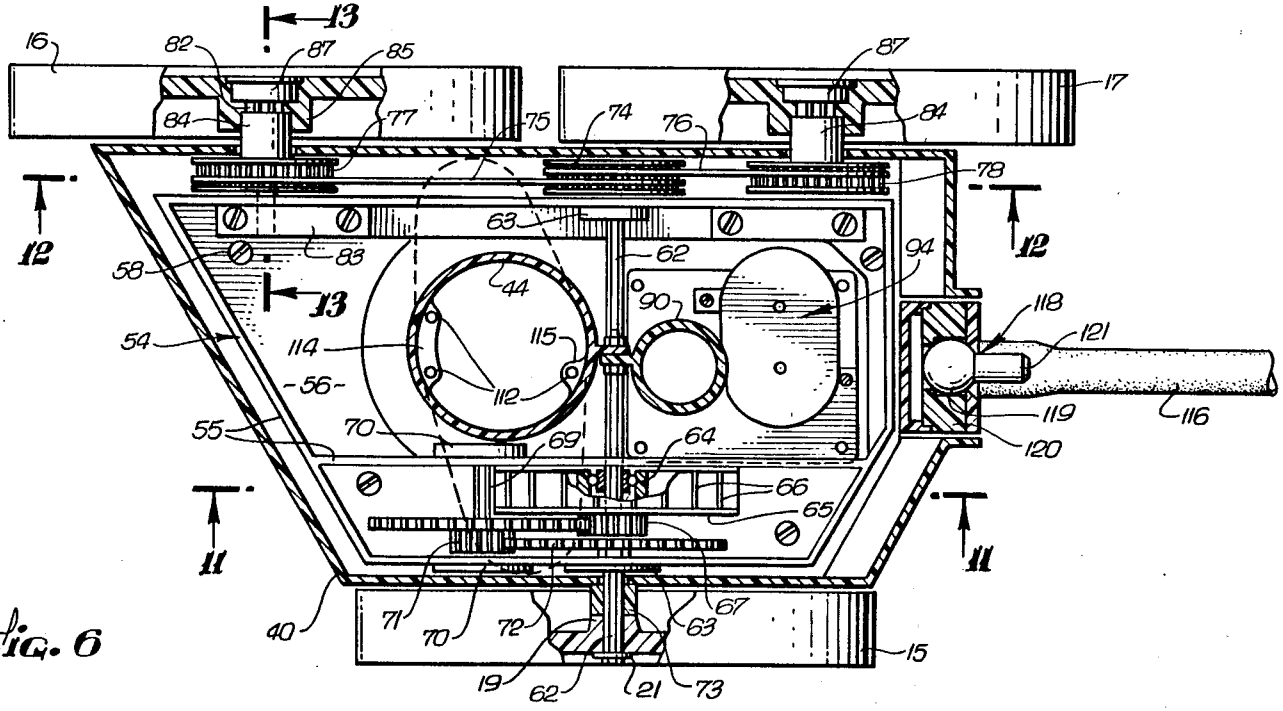
FIG. 6 is a horizontal section of the pool cleaner taken generally on the line 6—6 of FIG. 5.
Figure 11:
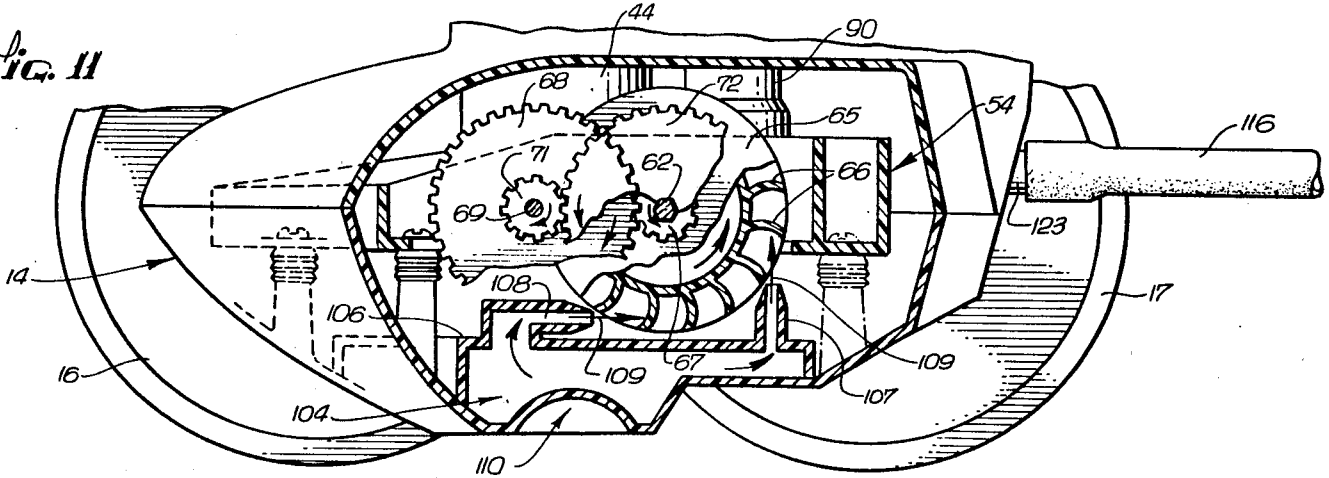
FIG. 11 is a longitudinal vertical section taken generally on the line 11—11 of FIG. 6.

As shown best in FIGS. 6 and 11, the vertical walls 55 of the drive train support frame 54 carry a central, transversely extending drive shaft 62 preferably of a hexagonal cross section. This drive shaft 62 is suported for rotation relative to the frame 54 by a pair of support bearings 63 in opposite lateral sides of the frame. While the specific form of these support bearings 63 may vary, a ball bearing assembly is preferred of the type having an inner ring secured for rotation with the shaft and an outer ring secured within an appropriate opening in the frame with an seals for bearing balls interposed between the rings. A third support bearing 64 of similar construction is carried by the shaft in a central lateral side of the frame 54, and this latter support bearing 64 in turn carries a water turbine 65 having an array of fan blades generally radially outwardly projecting turbine vanes 66.

The water turbine 65 may be formed conveniently from a lightweight molded plastic including, or appropriately secured to, a relatively small drive gear 67 at one axial side thereof. This drive gear 67 forms a first gear of a reduction gear train by virtue of meshed engagement with a second gear 68 carried by a short idler shaft 69 supported within a space in a pair of additional support bearings 70 on the spaced pair of the vertical walls 55 of the support frame 54. A comparatively small third gear 71 is formed integrally with the second gear 68 and is positioned in meshed relation with a larger fourth gear 72 keyed in any suitable manner onto the central drive shaft 62 for rotation therewith. According to a rotational movement of the water turbine 65 is transferred via the various reduction gears to rotate the central drive shaft 62 at a rotational speed proportional with but substantially less than the rotational speed of the water turbine.

The three cleaner wheels 15, 16, and 17 are all coupled with the central drive shaft 62 for driven rotation in response to rotational driving of the water turbine 65. More particularly, as shown in FIG. 6, the central drive shaft 62 has a sufficient length to project laterally outwardly from the drive train support frame 54 and through the associated axle opening 59,60 in the assembled housing 14. The shaft 62 projects further through a cylindrical spacer 73 and a hexagonal opening in a hub 19 in the single wheel 15 at the left side of the pool cleaner. The drive shaft 62 terminates with a retainer groove at the outboard side of the wheel hub 19, and a C-shaped retainer 21 is fitted into this groove to hold the wheel 15 in place and in driven relation with the shaft 62.

At the right side of the pool cleaner 10, the central drive shaft 62 projects laterally through the associated support bearing 63 for driving reception into an appropriately shaped hub (not shown) of a drive sprocket 74 keyed in any suitable manner onto the shaft for rotation therewith. This drive sprocket 74 is positioned between the support frame 54 and the assembled housing 14, and has a toothed periphery for positive drive engagement with a pair of toothed timing belts 75 and 76. These timing belts 75 and 76 respectively extend from the drive sprocket 74 in a forward direction about a driven toothed sprocket 77 and in a rearward direction for reception about a second driven toothed sprocket 78.

Figure 13:
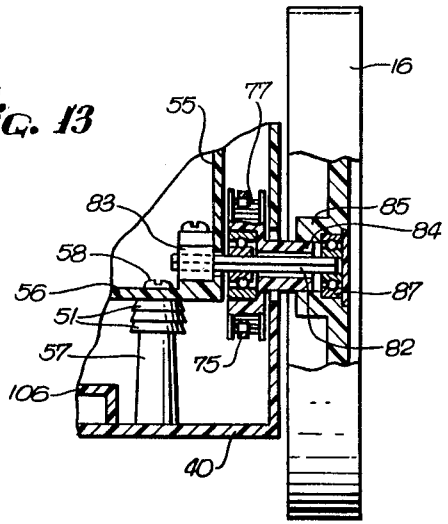
FIG. 13 is a fragmented transverse vertical section taken generally on the line 13—13 of FIG. 6.
Figure 12:
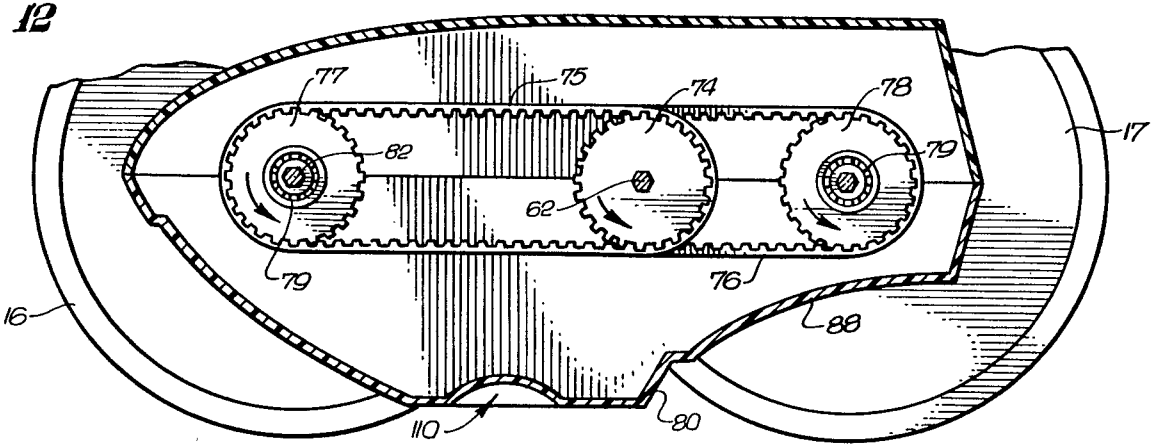
FIG. 12 is a longitudinal vertical section taken generally on the line 12—12 of FIG. 6.

The two driven sprockets 77 and 78 are generally identical with one another and are supported in generally the same manner for rotation relative to the drive train support frame 54. More particularly, as shown in FIGS. 6, 12, and 13 by way of example with respect to the forward driven sprocket 77, the sprocket is carried as by press-fitting onto the outer ring of an additional support bearing 79 having its inner ring keyed onto a short stub shaft 82 of hexagonal cross section and seated nonrotationally within a support block 83 on the drive train frame 54. The driven sprocket is thus free to rotate on the stub shaft 82 along with the outer ring of the bearing in response to rotational movement transferred thereto by means of the associated timing belt. A laterally outwardly projecting drive hub 84 formed integrally with the driven sprocket extends through the adjacent axle opening 59,60 in the assembled housing 14 and further into an enlarged hub 85 of the forward cleaner wheel 16. The relative fit between the drive hub 84 and the wheel hub 85 is chosen for transfer of rotational motion to the wheel 16, with the hubs 84 and 85 being securely fastened together by means of a tight friction fit or by use of an adhesive or the like, if desired. The stub shaft 82 extends from the frame support block 83 through the drive hub 84 and has an outboard end keyed into the inner ring of an additional support bearing 87, the outer ring of which is secured as by press-fitting into the wheel hub 85.

Accordingly, rotational driving of the water turbine 65 of the drive train 52 results in rotational driving of the three cleaner wheels 15, 16, and 17 at a common rotational speed, thereby propelling the cleaner over the surfaces of the pool floor 18 and sidewalls 20 at a relatively slow rate of travel. The transfer of rotational motion to the wheels is accomplished by direct connection of the drive shaft 62 with the single left wheel 15 and by use of the drive sprocket 74 and the driven sprockets 77 and 78 for transferring rotational motion to the two right-side wheels 16 and 17. Importantly, except for the wheels 15–17 and the associated axle structures, all moving components of the drive assembly are encased in a protected position within the substantially enclosed cleaner housing 14 protected against inadvertent contact with debris, such as twigs, pebbles, or the like, which could otherwise jam or interfere with drive train operation. Moreover, all bearings for the drive train and the wheels are arranged in relatively widely spaced pairs to decrease bearing wear and minimize requirements for extremely precise bearing tolerances.

The water turbine 65 of the drive train 52 is supplied with pressurized water from the flexible hose 37 (FIG. 1). More specifically, as shown in FIGS. 2, 3, and 5, the water supply hose 37 has a downstream end 37' shaped to fit snugly over the upper end of a tubular water supply mast 90 of molded plastic or the like mounted within the cleaner housing 14 and protruding upwardly with close clearance through a circular opening defined by cooperating semicircular recesses 91 and 92 formed in the upper cowlings 41 and 42. The protruding upper end of this supply mast is desirably tilted slightly in a rearward direction by a small angle on the order of about 15 degrees to minimize or eliminate dragging effects which might otherwise be applied by the hose 37 to the pool cleaner 10, particularly when the pool cleaner operates in shallow water with the distance between the suction mast and the horizontally floating hose being relatively short.

Within the housing 14, the supply mast extends generally in parallel with the suction mast 44 and terminates in an enlarged lower end 90' seated over the upper end of a primary flow tube 93 of the back up valve assembly 94, to be described in more detail, with a resilient annular seal 95 being captured between the mast and flow tube to eliminate water leakage. Conveniently, the supply mast 90 is locked in position by means of a forward and vertically elongated thin mounting bracket 96 having vertically spaced openings 97 in registry with the openings 46 of the suction mast mounting bracket 45, with short bolts 98 being passed through aligned pairs of the bracket openings for attaching the supply mast 90 to the suction mast 44. In this regard, the screw 48 for attaching the housing cowlings 41 and 42 passes through one aligned pair of the openings in the suction and supply mast mounting brackets. Moreover, the supply mast 90 provides a convenient mounting structure for a hollow ballast float 100 carried at a relatively high and rearward position with respect to the cleaner housing 14, wherein this ballast float 100 is threaded onto a support arm 101 formed integrally with and projecting rearwardly from the supply mast 90 through an opening defined by cooperating semicircular recesses 102 and 103 in the housing cowlings 41 and 42.

The above-described water supply mast 90 guides pressurized water from the flexible hose 37 downwardly through the primary flow tube 93 of the back up valve assembly 94 for further passage downwardly into an open pressure manifold 104. This pressure manifold 104 is disposed at the bottom of the housing base 40 and is formed cooperatively by the base and a contoured platform 106 having a size and shape for secured mounting into the base in spaced relation with a lower portion thereof.

The pressure manifold 104 provides a common chamber or plenum from which appropriately proportioned water flows are discharged for hydraulic operation of the various cleaner components. For example, as shown in FIG. 11, a pair of jet nozzles 107 and 108 direct a pair of water jets depicted by arrows 109 in driving relation against the arcuate vanes 66 of the water turbine 65. These water jets thus rotatably drive the water turbine 65 at a rapid rotational speed resulting in transfer or rotational power with speed reduction to the three cleaner wheels 15–17, as described previously. The provision of two jet nozzles 107 and 108 advantageously increases the overall water mass flow rate impacting the turbine wheel thereby providing rotational driving energy greater than with a single jet nozzle to correspondingly permit improved turbine driving at relatively lower water pressures. This high water mass flow enters the general interior chamber 43 of the housing 14 after impact with the turbine vanes, wherein this water flow is chosen relative to the sizes of the various housing openings, for example, adjacent the wheels and the suction and supply masts, to result in a slight internal housing pressurization during cleaner operation to inhibit entry of dirt or other foreign matter which might interfere with desired cleaner operation.

The pressure manifold 104 includes additional discharge passage for water to hydraulically operate the vacuum system for picking up and collecting debris within the collection bag 22. More particularly, as depicted in FIGS. 5–10, the pressure manifold 104 annularly surrounds the lower end of the central suction mast 44. The lower end of this suction mast is joined to a transversely elongated and downwardly opening intake funnel 110 defined by sloping bottom wall portions 111 of housing base 40. A plurality of relatively small jet pump orifices 112 are arranged about the inner diameter surface of the suction mast lower end for directing a plurality of water jets in an upward and slightly radially inward direction within the interior of the suction mast 44. These upwardly directed water jets are depicted in FIGS. 5 and 9 by the arrows 113 and effectively serve to draw a substantial additional water flow in an upward direction from the region of the intake funnel 110 through the suction mast 44 upwardly through the collection bag 22. This upward and substantial water flow through the suction mast effectively vacuums debris and other sediment from the surface of the pool floor and sidewalls to carry the drawn debris upwardly for collection within the bag 22. Moreover, the relatively closely spaced and adjustably positioned relationship between the periphery of the intake funnel 110 and adjacent surfaces of the pool effectively holds the pool cleaner against the pool surface to substantially increase wheel traction and to permit the cleaner to adhere to the vertical sidewalls 20 of the pool as the cleaner travels about within the pool.

Figure 8:
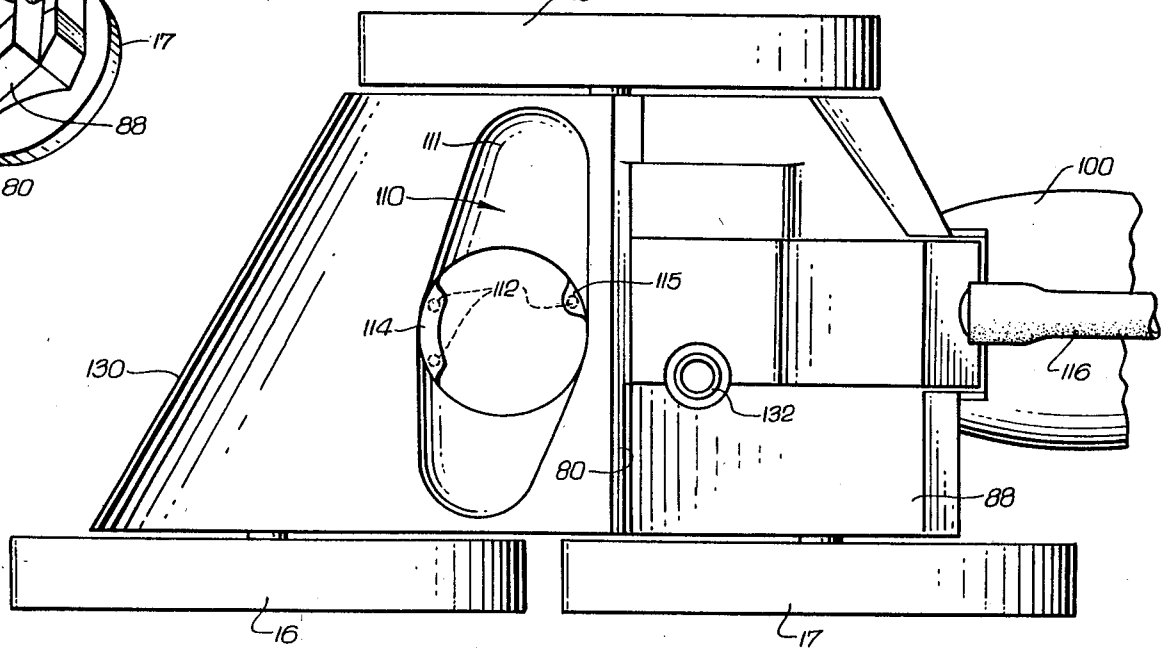
FIG. 8 is a bottom plan view of the pool cleaner taken generally on the line 8—8 of FIG. 5.
Figure 7:
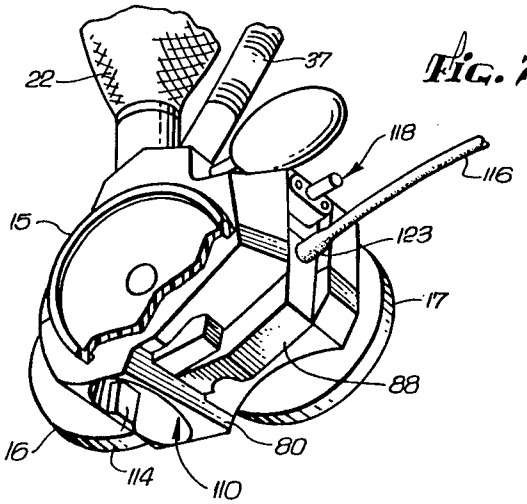
FIG. 7 is a partial, generally bottom perspective view of the pool cleaner.
Figure 9:
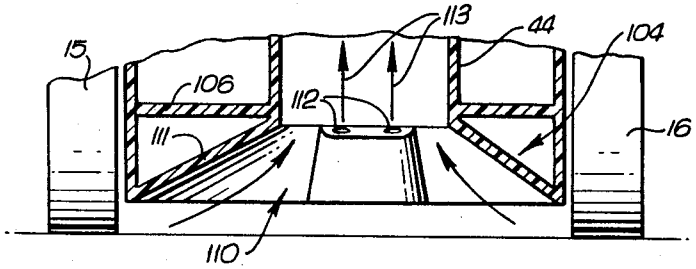
FIG. 9 is a fragmented transverse vertical section taken generally on the line 9—9 of FIG. 5.
Figure 10:
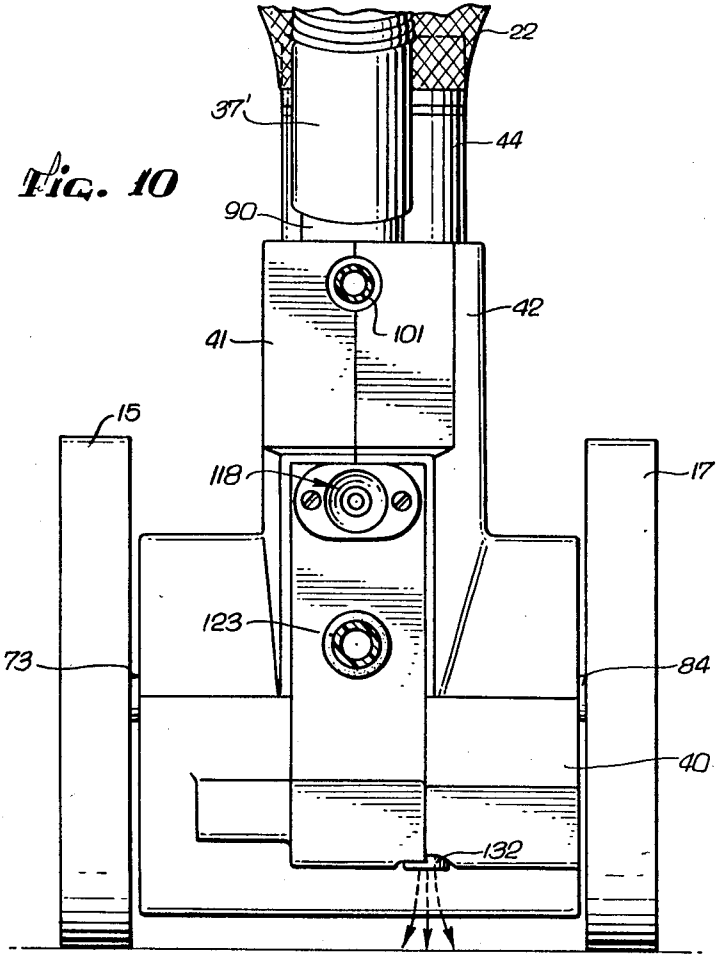
FIG. 10 is a rear elevation view of the pool cleaner taken generally on the line 10—10 of FIG. 5.

As shown best in FIGS. 6 and 8, the jet pump orifices 112 are formed within relatively small protrusions 114 and 115 lining the inner diameter surface of the suction mast 44. These orifices 112 are thus positioned substantially away from a central vertical axis of the suction mast where the orifice-forming structure does not significantly interfere with suction mast water flow. However, the protrusions 114 and 115 permit the orifices 112 to open predominantly in a vertical direction with a minimum radial inclination of, for example, about 15 degrees or less, such that the discharged water jets are directed predominantly in an upward direction for maximum drawing effect upon debris within the pool. The plurality of orifice water jets are designed to discharge a sufficient combined water flow rate to achieve the desired vacuuming effects, wherein the vacuuming effects are further enhanced by positioning the orifices 112 in an at least roughly symmetric relation about the inner diameter of the suction mast, as viewed in FIG. 6.

Operation of the hydraulic vacuum system is further enhanced by appropriate contouring of the bottom geometry of the housing base 40, particularly in a region behind the intake funnel 110, to enhance cleaner traction with a pool surface and thereby enhance cleaner efficiency. More specifically, with reference to FIGS. 5 and 7–13, the bottom profile of the housing base 40 includes a generally upstanding transverse shoulder 80 in a position closely behind the funnel 110 wherein this shoulder 80 has its upper extent joined to a generally rearwardly extending rear portion 88 of the housing which is spaced above the underlying pool surface by a distance substantially greater than the spacing of the housing portion surrounding the funnel 110. The housing base 40 is thus provided with an abrupt increase in pool surface spacing over the rear portion 88. This rear spacing minimizes a low pressure region beneath the cleaner resulting from suction mast water flow at a position behind an imaginary triangle having apexes at the rotational centers of the wheels 15, 16, and 17, while not affecting the corresponding low pressure region forward of this triangle. As a result, water flow through the suction mast 44 causes greater adherance or traction of the forwardmost wheel 16 to prevent lifting thereof from the pool surface in response to drag forces and the like, wherein such lifting of the front wheel otherwise virtually destroys debris collecting capability.

Additional discharge flows are taken from the pressure manifold 104 providing a stabilizing thrust jet and for operating a trailing flexible sweep hose 116. More particularly, with reference to FIGS. 5–10, a rear portion of the housing base 40 cooperates with the rear portion 88 of the manifold-forming platform 106 to define a water flow passage 117 leading to an upper, rearwardly directed thrust jet nozzle 118. This thrust jet nozzle has a bulbous-shaped base 119 frictionally trapped within an appropriately shaped and rearwardly opening retainer 120 to permit manual adjustment of the specific angular orientation of a rearwardly directed nozzle arm 121. The nozzle arm 121 can thus be set to open directly rearwardly for rearward discharge of a thrust water jet depicted by arrow 122 in FIG. 5, or angularly adjusted to open generally rearwardly and angularly, as desired. This thrust jet 122 creates a reaction force of controlled direction which functions to assist forward driving movement of the cleaner 10 and further provides a downward turning moment with respect to the underlying rotational axes of the wheels 15 and 17 to increase traction of the front wheel 16 with pool surfaces.

The water flow passage 117 also opens to a rearwardly directed sweep hose jet nozzle 123 positioned vertically below the thrust jet nozzle 118. This sweep hose jet nozzle 123 is adapted for connection to the trailing flexible sweep hose 116 of conventional design and as shown best in FIG. 2. The sweep hose 116 functions upon flow of pressurized water therethrough to whip about and disturb sediment of other fine particulate matter settled onto pool surfaces thereby suspending such particulate within the pool water where it can be collected and filtered through the main pool filtration system 28 (FIG. 1). Conveniently, the sweep hose 116 includes at periodic positions along its length a plurality of enlarged, relatively hard rings 125 of plastic or the like to decrease hose wear which might otherwise occur from constant movement over pool surfaces.

In operation, the pool cleaner 10 thus responds to supply of pressurized water through the flexible hose 37 to drive the wheels 15–17 in a manner propelling the cleaner slowly in a forward direction over surfaces of the pool floor 18 and sidewalls 20. Simultaneously, debris is water-vacuumed upwardly through the suction mast 44 for collection within the porous bag 22, while sediment is disturbed and suspended within the pool water by a combination of the suction mast flow and the whipping action of the trailing sweep hose 116. Simultaneously, pool chemicals such as chlorine, which are heavier than the water and thus tend to congregate near the pool floor, are stirred about as the cleaner operates for relatively uniform distribution throughout the pool.

When the pool cleaner reaches an obstruction preventing further direct forward travel, the front nose 130 of the cleaner housing 14 imparts a turning movement to the cleaner by virtue of an angularly set contour extending forwardly and laterally from the left wheel 15 toward the front right wheel 16. The cleaner 10 thus tends to turn in place and continue travel in a different direction. Alternatively, when the cleaner travels along the pool floor 18 and then reaches a smoothly curved region merging with a sidewall 20, the cleaner tends to travel through the curved region and crawl up the pool sidewall with suction-assisted wheel traction until breaking the water surface to relieve the suction-assisted traction. The pool cleaner 10 then falls by gravity back to the floor 18 of the pool, with the ballast float 100 assuring a low overall center of gravity causing the cleaner to land upright on the pool floor 18 and resume travel in a forward direction. The combination of these various movements results in an overall random cleaner travel throughout the swimming pool to collect and dislodge debris.

In some swimming pools, the particular shapes of floor and sidewall surfaces may provide one or more relatively confined regions within which the pool cleaner may become trapped. To prevent cleaner entrapment, notwithstanding the presence of such confined regions, the back up valve assembly 94 is integrated into the cleaner housing and includes an hydraulic timer for periodically diverting some or all of the water flow from the supply mast 90 through a back up port 132 projecting through the rear portion 88 of the housing base to drive the cleaner generally rearwardly and/or upwardly within the pool water for a short time interval. The back up valve assembly 94 then resumes normal water supply through the supply mast 90 into the pressure manifold 104 for resuming normal cleaner operation.

The back up valve assembly 94 is shown in more detail in FIGS. 14–17 to include the primary flow tube 93 coupled directly between the supply mast 90 and the pressure manifold 104. Near the upper end of this primary flow tube 93, a small bleed port 133 permits a small bleed flow of water to pass radially outwardly from the flow tube 93 in a direction generally perpendicular to water flow through the flow tube, thereby dynamically preventing particulate of any significant size from passing through the bleed port 133. This bleed flow enters a reduction gear housing 134 and impinges upon vanes 135 of a water wheel 136 supported for free rotation about a vertically mounted shaft 137. Subsequent to driving contact with the water wheel 136, the bleed flow exits the reduction gear housing 134 through an outlet opening 138 for passage into the chamber 43 of the cleaner housing.

The rotatably driven water wheel 136 is formed from molded plastic or the like and is integral or suitably coupled with a first gear 140 of a multigear reduction gear train 141. This first gear 140 is one of several stacked gears rotatably supported on the shaft 137 in meshed relation with several vertically stacked gears rotatably supported on an adjacent idler shaft 142 mounted within the housing 134. The stacks of gears of the reduction gear train 141 ultimately transfer rotational motion to a lower gear 143 keyed on the shaft 137 which in turn projects from the gear housing 134 downwardly into an expanded lower chamber 144 at the lower end of the primary flow tube 93.

The shaft 137 is thus rotatably driven by the water wheel 136 at a rotational speed proportional to but substantially less than the rotational speed of the water wheel. The lower end of this shaft 137 carried a drive plate 145 including a downwardly projecting and closely spaced pair of drive pins 146 mounted near the drive plate periphery to relatively slowly rotate about the axis of the shaft 137. These drive pins 146 on the plate 145 rotate without interference through the major portion of the rotational motion of the plate 145. However, through a small angular increment of the rotational movement of the plate, the drive pins 146 are carried into engagement with one of four equally spaced and radially open slots 147 of an adjacent Geneva wheel 148 supported for rotation by a short driven shaft 149. This Geneva wheel 148 in turn is secured to a back up valve plate 150 having a pair of oppositely disposed arcuate segments 151 for respective relative opening and closing of the primary flow tube 93 for water flow to the pressure manifold 104 and the back up port 132 for water discharge in a forward and/or rearward direction beneath the housing 14.

As the drive plate 145 rotates to move the drive pins 146 into engagement with the Geneva wheel 148, the leading pin 146 moves into an open slot 147 to rotate the Geneva wheel and the valve plate 150 through an angle of about 90 degrees in a relatively short period of time. Such valve plate movement displaces one of the segments 151 from a position closing the back up port 132 to water flow to a position instead closing or substantially blocking water flow into the pressure manifold 104. This diverts some of the water flow to the pressure manifold 104 through the back up port to displace the cleaner rearwardly and/or upwardly, as described above, in accordance with the particular directional orientation of the back up port 132, with a downward orientation being depicted by way of example in FIG. 10.

Within a few seconds, say about 10 to 15 seconds, the first drive pin 146 exits the now-rotated Geneva wheel slot 147 and the second drive pin 146 advances into a subsequent wheel slot 147 to rotate the Geneva wheel through a subsequent 90 degrees. The valve plate is thus returned to an initial or normal condition closing flow to the back up port 132 and opening flow to the pressure manifold 104. Accordingly, the back up valve assembly 94 operates to regularly and periodically reverse the direction of cleaner motion for a short time interval thereby insuring against cleaner entrapment within a confined region of a swimming pool.

Figure 14:
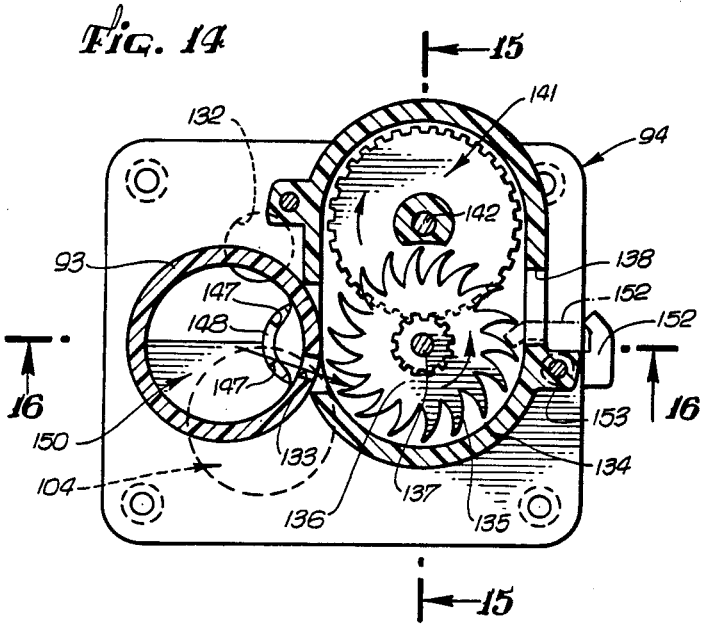
FIG. 14 is an enlarged horizontal section taken generally on the line 14—14 of FIG. 5.
Figure 15:
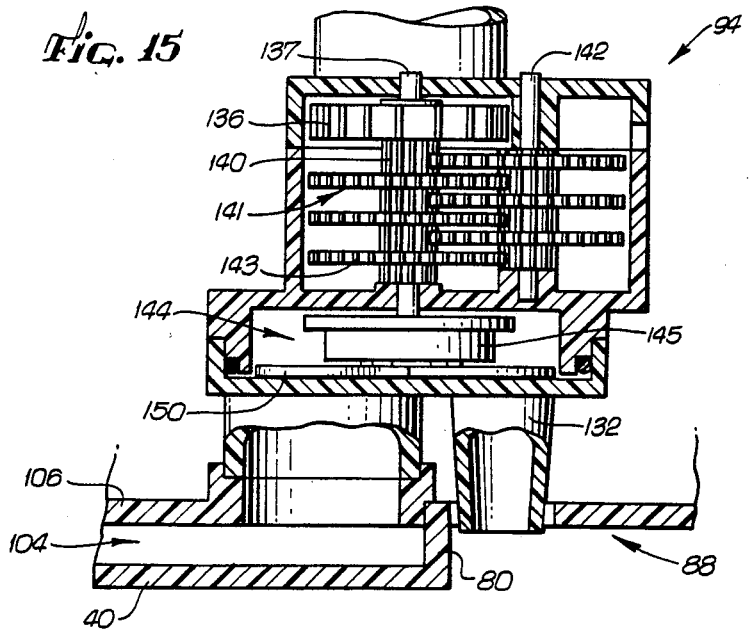
FIG. 15 is a fragmented transverse vertical section taken generally on the line 15—15 of FIG. 5.
Figure 16:
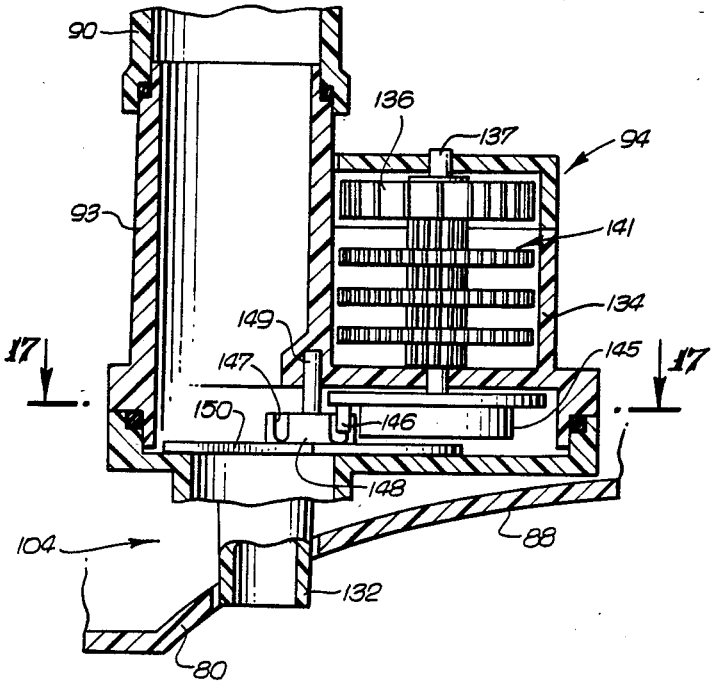
FIG. 16 is a fragmented longitudinal vertical section taken generally on the line 16—16 of FIG. 14.
Figure 17:
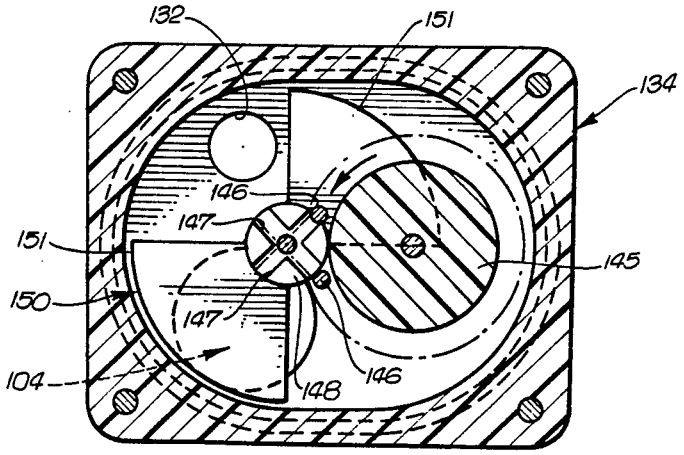
FIG. 17 is a horizontal section taken generally on the line 17—17 of FIG. 16.

For some swimming pools, the particular shape and geometry of the floor and sidewalls may not provide any significant confined region such that periodic backing up of the pool cleaner is not required. Instead, it may be desired to continue forward cleaner travel and vacuuming operation at all times thereby maximizing cleaner effectiveness as a function of time. To this end, a disable lever 152 having a generally hook-shaped configuration, as depicted in FIG. 14, is swingably mounted on a screw 153 adjacent the outlet opening 138 of the reduction gear housing 134. This disable lever 152 may have its free end retracted from the outlet opening to permit free water wheel rotation when periodic cleaner back up is desired. Alternatively, the disable lever 152 may be rotated to move its free end into interference contact with the water wheel vanes 135 thereby blocking the water wheel 136 against rotation when the back up valve assembly 94 is in a normal cleaner operating position. Cessation of water wheel rotation effectively disables the back up valve assembly to prevent periodic cleaner back up.

Figure 18:
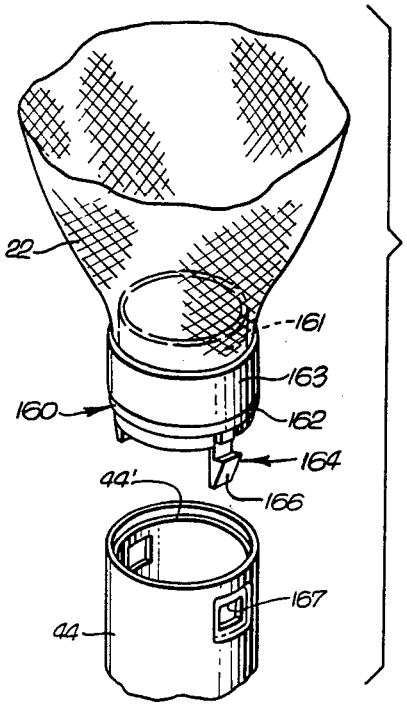
FIG. 18 is an enlarged fragmented exploded perspective view illustrating attachment of a debris collection bag to the upper end of a suction mast for the pool cleaner.
Figure 19:
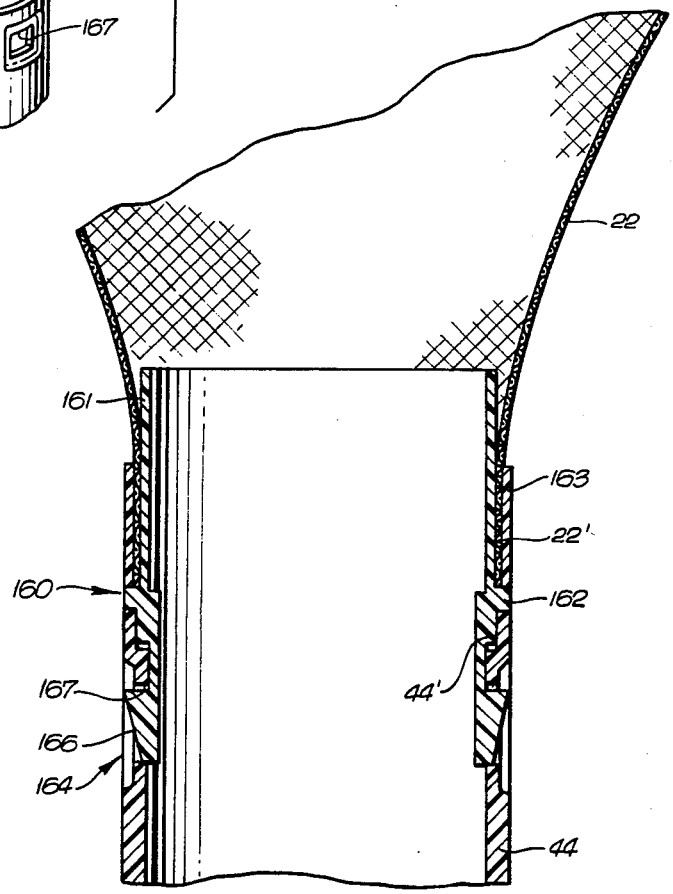
FIG. 19 is an enlarged fragmented transverse vertical section taken generally on the line 19—19 of FIG. 5.

In accordance with a further feature of the improved pool cleaner 10 of the present invention, the collection bag 22 is provided with an improved mounting ring 160 for rapid and simplified installation and/or removal with respect to the upper end of the suction mast 44. More specifically, as shown in FIGS. 18 and 19, the mounting ring 160 comprises an upstanding support cylinder 161 which projects upwardly a substantial distance within a lower reduced diameter neck 22' of the collection bag 22. This support cylinder 161 has a lower end joined to an enlarged flange 162. The collection bag neck 22' is drawn over the support ring 161 into a position near or abutting the flange 162, after which an outer locking collar 163 is snugly seated about the bag and support ring 161 to lock the bag in place. A suitable adhesive may be provided between the collar and the support ring to permanently secure the bag, if desired.

Below the flange 161, the ring 160 is shaped for sliding reception into a shallow counterbore 44' at the upper end of the suction mast 44 and further into flush annular supported engagement with the lower extent of the counterbore. A pair of latch clips 164 project downwardly from the mounting ring 160 beyond the counterbore and terminate in outwardly presented and downwardly pointed wedge plates 165. These latch clips are designed for resilient displacement toward each other for reception of the wedge plates 165 downwardly into the suction mast upper end, followed by resilient outward tab movement for locked and seated reception into matingly shaped openings 167 formed near the upper end of the suction mast. Accordingly, the mounting ring can be installed rapidly onto the suction mast and further may be removed easily by mere inward depression on the wedge plates 165 followed by separation of the mounting ring 160 and bag 122 from the suction mast. With this mounting construction, the bag 22 tends not to sag downwardly about the upper end of the suction mast 44 where the debris otherwise may tend to fall out of the collection bag when the bag is removed for emptying.

The improved pool cleaner 10 of the present invention thus operates efficiently and economically for effective collection and dislodging of debris within a swimming pool, all without requiring significant operator attention. The cleaner is designed for efficient hydraulic operation as well as facilitated assembly and disassembly. Although cleaner maintenance is generally not required, except for periodic emptying of the collection bag 22, the various components of the cleaner are easily accessed by the cleaner owner for component repairs or replacement as needed.

A variety of modifications and improvements to the pool cleaner described herein are believed to be apparent to those of ordinary skill in the art. Accordingly, no limitation upon the invention is intended, except as set forth in the appended claims.

What is claimed is:

1. A pool cleaner for travel along submerged surfaces of a swimming pool to collect and dislodge debris, comprising:

a cleaner housing;

a drive assembly including a plurality of wheels positioned outside said housing for supporting and driving the cleaner, axle means extending from within said housing to outside said housing and connected to said wheels outside said housing, and a drive train substantially encased within said housing for rotatably driving at least one of said wheels through said axle means; and a vacuum system including a collection bag and means for inducing a water flow from a submerged surface of the pool into said bag for drawing debris from within the pool into said bag for collection, said vacuum system further including a suction mast mounted on said housing and defining an open flow path from a lower end positioned generally beneath said housing to an upper end disposed generally above said housing, said collection bag being for mounting generally at the upper end of said suction mast and said water flow inducing means being for drawing the water flow and debris through said suction mast into said collection bag;

said drive assembly and said axle means and said wheels comprising a preassembled unit, and said housing comprising a generally upwardly open and shell-shaped housing base including means for seated reception of said drive train, said suction mast being joined with said housing base and projecting upwardly therefrom, said housing further including a pair of mating and generally shell-shaped cowlings together defining a generally downwardly open housing portion sized to fit with close tolerance about said suction mast and in conformance with said housing base to encase said drive train, and further including means for securing said housing base, said suction mast, and said cowlings with respect to each other.

2. The pool cleaner of claim 1 wherein said securing means comprises a mounting bracket formed on said suction mast and a fastener coupled between said cowlings and received through an opening in said mounting bracket.

3. The pool cleaner of claim 1 wherein said plurality of wheels comprises a pair of wheels at one side of said housing and a third wheel at an opposite side of said housing, said wheels being mounted for rotation about axes offset relative to one another and said housing including a front nose set angularly with respect to the direction of cleaner movement.

4. The pool cleaner of claim 1 wherein said housing base includes a front end and a rear end with a bottom profile extending therebetween and defined by a first portion adjacent and surrounding the lower end of said suction mast in relatively closely spaced relation with respect to the surface of a swimming pool and a second portion adjacent said first portion and between said first portion and said housing base rear end, said second portion being spaced substantially from the surface of a swimming pool relative to the spacing of said bottom profile between said first portion and said front end.

5. The pool cleaner of claim 4 wherein said plurality of wheels comprises first and second wheels at one side of said housing and a third wheel at an opposite side of said housing, said first, second, and third wheels being mounted for rotation about offset axes and the rotational centers of said wheels defining apexes of a triangle, said second portion of said bottom profile being disposed generally outside said triangle.

6. The pool cleaner of claim 1 wherein said suction mast has a pair of generally opposed openings formed therein adjacent said upper end, and further including means mounted on said collection bag at an open end thereof for removable attachment of said collection bag to said suction mast, said attachment means including a pair of opposed latch clips for depression toward one another and oriented to extend into said suction mast in alignment with said mast openings, said latch clips having outwardly projecting tabs for releasable locked reception into said mast to secure said bag onto said suction mast.

7. A pool cleaner for travel along submerged surfaces of a swimming pool to collect and dislodge debris, comprising:

a cleaner housing:

a drive assembly including a plurality of wheels positioned outside said housing for supporting and driving the cleaner and a drive train substantially encased within said housing for rotatably driving at least one of said wheels; and a vacuum system including a collection bag and means for inducing a water flow from a submerged surface of the pool into said bag for drawing debris from within the pool into said bag for collection;

said vacuum system further including a suction mast mounted on said housing and defining an open flow path from a lower end positioned generally beneath said housing to an upper end disposed generally above said housing, said collection bag being for mounting generally at the upper end of said suction mast and said water flow inducing means being for drawing the water flow and debris through said suction mast into said collection bag;

said housing including a generally upwardly open and shell-shaped housing base including means for seated reception of said drive train, said suction mast being joined with said housing base and projecting upwardly therefrom, said housing further including a pair of mating and generally shell-shaped cowlings together defining a generally downwardly open housing portion sized to fit with close tolerance about said suction mast and in conformance with said housing base to encase said drive train, and further including means for securing said housing base, said suction mast, and said cowlings with respect to each other;

said water flow inducing means comprising a pressure manifold formed in said housing base in a position generally surrounding the lower end of said suction mast, a plurality of relatively small jet nozzles arranged generally about the periphery of said suction mast flow path and oriented to direct a plurality of individual water flows upwardly within said suction mast, and means for supplying water under pressure to said pressure manifold.

8. The pool cleaner of claim 7 wherein said pressure manifold is defined by said housing base and a platform mounted within said housing base.

9. The pool cleaner of claim 7 wherein said water supply means comprises a supply mast mounted on said housing with a downstream end in flow communication with said pressure manifold and an upstream end extending with relatively close tolerance to a position outside said housing, said supply mast being removably mounted within said housing.

10. The pool cleaner of claim 9 including a ballast float mounted on said supply mast at a relatively high elevational position with respect to said housing.

11. The pool cleaner of claim 9 further including a thrust jet mounted on said housing at a position generally above the rotational axes of said wheels and opening in a direction generally opposite the direction of cleaner movement, a sweep hose jet mounted on said housing at a position below said thrust jet, a flexible sweep hose coupled to said sweep hose jet and extending in a direction for trailing said housing during cleaner movement, and means for coupling said thrust jet and said sweep hose jet to said pressure manifold for communication with the supply of water under pressure supplied to said pressure manifold.

12. The pool cleaner of claim 9 further including a back up valve assembly mounted within said housing generally between said water supply mast and said drive train, said back up valve assembly including a back up jet port opening generally downwardly to the exterior of said housing, and an hydraulic timer driven by said flow of water under pressure and including means for periodically diverting said flow of water under pressure from said pressure manifold through said back up port for a short time interval to create a reaction force driving said cleaner in a generally upward direction.

13. The pool cleaner of claim 12 wherein said back up valve assembly includes a primary flow tube coupled between said supply mast and said pressure manifold, means forming a bleed port for diverting a portion of the supply of water flowing through said supply mast in a direction generally perpendicular to the general direction of water flow through said primary flow tube into driving association with said hydraulic timer, and a back up valve plate driven by said hydraulic timer for directing the flow of water through said primary flow tube alternatively to said pressure manifold and said back up jet port.

14. The pool cleaner of claim 7 wherein said drive train includes a rotatable water turbine, means for coupling rotational motion of said water turbine to said wheels, and a second plurality of jet nozzles arranged for directing individual water flows from said pressure manifold into driving relation with said water turbine.

15. The pool cleaner of claim 14 wherein said plurality of wheels comprises a first wheel at one side of said housing and second and third wheels at an opposite side of said housing, said drive train further including a frame, and said coupling means comprising a drive shaft supported by said frame and having one end drivingly coupled to said first wheel and an opposite end drivingly coupled to a driving sprocket disposed within said housing, reduction gear means drivingly coupled between said water turbine and said drive shaft, a pair of driven sprockets within said housing each in driving association with a respective one of said second and third wheels, and belt means drivingly coupled between said driving sprocket and said pair of driven sprockets.

16. The pool cleaner of claim 15 wherein said drive shaft is supported on said frame by a pair of rotational bearings positioned respectively generally at opposite sides of said frame.

17. The pool cleaner of claim 15 wherein each of said driven sprockets is supported by an inner bearing for rotation about a nonrotational shaft within said housing, said inner bearing including a drive hub projecting with relatively close tolerance through an opening formed in said housing for driving reception into an enlarged wheel hub formed on the associated one of said second and third wheels, said nonrotational shaft also projecting through said housing opening and having an outboard end carried within an outer bearing rotationally mounting said associated one of said second and third wheels on said nonrotational shaft.

18. The pool cleaner of claim 15 wherein said water turbine is rotationally supported by said drive shaft.

19. The pool cleaner of claim 15 wherein said drive train and said first, second, and third wheels comprises a preassembled unit, said frame including means for mounting said unit within said housing base.

20. The pool cleaner of claim 14 wherein water under pressure directed through said turbine jet nozzles into driving relation with said water turbine is discharged into the interior of said housing, the flow rate of water into driving relation with said water turbine being sufficient relative to openings formed in said housing to at least slightly pressurize the housing interior during cleaner operation.

21. The pool cleaner of claim 20 including means for disabling said hydraulic timer.

22. A pool cleaner for travel along submerged surfaces of a swimming pool to collect and dislodge debris, comprising:

a cleaner housing:

a drive assembly including a plurality of wheels positioned outside said housing for supporting and driving the cleaner and a drive train substantially encased within said housing for rotatably driving at least one of said wheels;

a vacuum system including a collection bag and means for inducing a water flow from a submerged surface of the pool into said bag for drawing debris from within the pool into said bag for collection;

said vacuum system further including a suction mast mounted on said housing and defining an open flow path from a lower end positioned generally beneath said housing to an upper end disposed generally above said housing, said collection bag being for mounting generally at the upper end of said suction mast and said water flow inducing means being for drawing the water flow and debris through said suction mast into said collection bag; and means for adjustably mounting said drive assembly within said housing for controllably selecting the distance between the lower end of said suction mast and the surface of a swimming pool.

23. The pool cleaner of claim 22 wherein said drive train includes a frame, said mounting means comprising a plurality of adjustable height support bosses within said housing for supporting said frame and means for connecting said frame to said support bosses.

24. A pool cleaner for travel along submerged surfaces of a swimming pool, comprising:

a drive train including a frame, a drive shaft rotatably supported on said frame, and a water turbine rotatably supported on said frame and drivingly coupled to said drive shaft;

a plurality of cleaner wheels;

axle means coupled between said drive shaft and said wheels for supporting said wheels in driving relation with respect to said drive shaft;

a cleaner housing including a generally upwardly open and shell-shaped housing base having an open and generally vertically oriented suction mast joined thereto, and a pair of generally shell-shaped cowlings adapted to fit matingly to define a generally downwardly open housing portion shaped to fit about said suction mast and in conformance with said housing base;

means for defining a pressure manifold comprising a pressure plenum within said housing and including a first jet nozzle in communication with said manifold and opening upwardly within said suction mast and a second jet nozzle in communication with said manifold and opening in a direction for discharging a water flow into driving relation with said water turbine, said first and second nozzles having upstream ends opening substantially directly into said plenum;

an open supply mast having a downstream end coupled with said pressure manifold and an upstream end outside said housing for coupling said manifold to a supply of water under pressure whereby water is supplied to the upstream ends of said first and second nozzles at substantially the same pressure; and means for securing said drive train in a position encased within said housing with said axle means projecting through relatively small openings defined by said housing and said wheels disposed outside said housing.

25. The pool cleaner of claim 24 further including a collection bag mounted at the upper end of said suction mast.

26. The pool cleaner of claim 24 including a ballast float mounted on said supply mast at a relatively high elevational position with respect to said housing.

27. The pool cleaner of claim 24 wherein said second jet nozzle comprises a plurality of turbine jet nozzles for discharging water flows into driving relation with said water turbine at different locations about the periphery of said water turbine.

28. The pool cleaner of claim 24 wherein said housing base has a platform mounted therein and cooperating therewith to form said pressure manifold.

29. The pool cleaner of claim 24 including means for removably attaching said supply mast directly to said suction mast for support of said supply mast by said suction mast, and further including means for nonrigidly coupling the downstream end of said supply mast with said pressure manifold.

30. The pool cleaner of claim 24 wherein said supply mast includes an upper end outside said housing angled upwardly and rearwardly in a direction away from the direction of cleaner movement.

31. The pool cleaner of claim 24 wherein said securing means includes means for adjustably mounting said drive assembly within said housing for controllably selecting the distance between the lower end of said suction mast and the surface of a swimming pool.

32. A pool cleaner for travel along submerged surfaces of a swimming pool, comprising:

a drive train including a frame, a drive shaft rotatably supported on said frame, and a water turbine rotatably supported on said frame and drivingly coupled to said drive shaft;

a plurality of cleaner wheels;

axle means coupled between said drive shaft and said wheels for supporting said wheels in driving relation with respect to said drive shaft;

a cleaner housing including a generally upwardly open and shell-shaped housing base having an open and generally vertically oriented suction mast joined thereto, and a pair of generally shell-shaped cowlings adapted to fit matingly to define a generally downwardly open housing portion shaped to fit about said suction mast and in conformance with said housing base;

means for defining a pressure manifold within said housing and including a first jet nozzle in communication with said manifold and opening upwardly within said suction mast and a second jet nozzle in communication with said manifold and opening in a direction for discharging a water flow into driving relation with said water turbine;

an open supply mast having a downstream end coupled with said pressure manifold and an upstream end outside said housing for coupling said manifold to a supply of water under pressure;

means for securing said drive train in a position encased within said housing with said axle means projecting through relatively small openings defined by said housing and said wheels disposed outside said housing; and a collection bag mounted at the upper end of said suction mast;

said suction mast having a pair of generally opposed openings formed therein adjacent said upper end, and further including means mounted on said collection bag at an open end thereof for removable attachment of said collection bag to said suction mast, said attachment means including a pair of opposed latch clips for depression toward one another and oriented to extend into said suction mast in alignment with said mast openings, said latch clips having outwardly projecting tabs for reception into said mast and releasable locked reception into said mast openings to secure said bag onto said suction mast.

33. A pool cleaner for travel along submerged surfaces of a swimming pool, comprising:

a drive train including a frame, a drive shaft rotatably supported on said frame, and a water turbine rotatably supported on said frame and drivingly coupled to said drive shaft;

a plurality of cleaner wheels;

axle means coupled between said drive shaft and said wheels for supporting said wheels in driving relation with respect to said drive shaft;

a cleaner housing including a generally upwardly open and shell-shaped housing base having an open and generally vertically oriented suction mast joined thereto, and a pair of generally shell-shaped cowlings adapted to fit matingly to define a generally downwardly open housing portion shaped to fit about said suction mast and in conformance with said housing base;

means for defining a pressure manifold within said housing and including a first jet nozzle in communication with said manifold and opening upwardly within said suction mast and a second jet nozzle in communication with said manifold and opening in a direction for discharging a water flow into driving relation with said water turbine;

an open supply mast having a downstream end coupled with said pressure manifold and an upstream end outside said housing for coupling said manifold to a supply of water under pressure; and means for securing said drive train in a position encased within said housing with said axle means projecting through relatively small openings defined by said housing and said wheels disposed outside said housing;

said first jet nozzle comprising a plurality of relatively small jet nozzles arranged generally about the interior periphery of said suction mast and opening generally upwardly and slightly angled toward a central axis of said suction mast.

34. A pool cleaner for travel along submerged surfaces of a swimming pool, comprising:

a drive train including a frame, a drive shaft rotatably supported on said frame, and a water turbine rotatably supported on said frame and drivingly coupled to said drive shaft;

a plurality of cleaner wheels;

axle means coupled between said drive shaft and said wheels for supporting said wheels in driven rotation with respect to said drive shaft;

a cleaner housing including a generally upwardly open and shell-shaped housing base having an open and generally vertically oriented suction mast joined thereto, and a pair of generally shell-shaped cowlings adapted to fit matingly to define a generally downwardly open housing portion shaped to fit about said suction mast and in conformance with said housing base;

means for defining a pressure manifold within said housing and including a first jet nozzle in communication with said manifold and opening upwardly within said suction mast and a second jet nozzle in communication with said manifold and opening in a direction for discharging a water flow into driving relation with said water turbine;

an open supply mast having a downstream end coupled with said pressure manifold and an upstream end outside said housing for coupling said manifold to a supply of water under pressure; and means for securing said drive train in a position encased within said housing with said axle means projecting through relatively small openings defined by said housing and said wheels disposed outside said housing;

said plurality of wheels comprising a first wheel at one side of said housing and second and third wheels at an opposite side of said housing, said drive shaft having one end drivingly coupled to said first wheel and an opposite end drivingly coupled to a driving sprocket disposed within said housing, said drive train further including reduction gear means drivingly coupled between said water turbine and said drive shaft, a pair of driven sprockets within said housing each in driving association with a respective one of said second and third wheels, and belt means drivingly coupled between said driving sprocket and said pair of driven sprockets.

35. The pool cleaner of claim 34 wherein each of said driven sprockets is supported by an inner bearing for rotation about a nonrotational shaft within said housing, said inner bearing including a drive hub forming said axle means projecting with relatively close tolerance through an opening formed in said housing for driving reception into an enlarged wheel hub formed on the associated one of said second and third wheels, said nonrotational shaft also projecting through said housing opening and having an outboard end carried within an outer bearing rotationally mounting said associated one of said second and third wheels on said nonrotational shaft.

36. A pool cleaner for travel along submerged surfaces of a swimming pool, comprising:

a drive train including a frame, a drive shaft rotatably supported on said frame, and a water turbine rotatably supported on said frame and drivingly coupled to said drive shaft;

a plurality of cleaner wheels;

axle means coupled between said drive shaft and said wheels for supporting said wheels in driving relation with respect to said drive shaft;

a cleaner housing including a generally upwardly open and shell-shaped housing base having an open and generally vertically oriented suction mast joined thereto, and a pair of generally shell-shaped cowlings adapted to fit matingly to define a generally downwardly open housing portion shaped to fit about said suction mast and in conformance with said housing base;

means for defining a pressure manifold within said housing and including a first jet nozzle in communication with said manifold and opening upwardly within said suction mast and a second jet nozzle in communication with said manifold and opening in a direction for discharging a water flow into driving relation with said water turbine;

an open supply mast having a downstream end coupled with said pressure manifold and an upstream end outside said housing for coupling said manifold to a supply of water under pressure; and means for securing said drive train in a position encased within said housing with said axle means projecting through relatively small openings defined by said housing and said wheels disposed outside said housing;

said housing base including a front end and a rear end with a bottom profile extending therebetween and defined by a first portion adjacent and surrounding the lower end of said suction mast in relatively closely spaced relation with respect to the surface of a swimming pool and a second portion adjacent said first portion and between said first portion and said housing base rear end, said second portion being spaced substantially from the surface of a swimming pool relative to the spacing of said bottom profile between said first portion and said front end.

37. The pool cleaner of claim 36 wherein said plurality of wheels comprises first and second wheels at one side of said housing and a third wheel at an opposite side of said housing; said first, second, and third wheels being mounted for rotation about offset axes and the rotational centers of said wheels defining apexes of a triangle, said second portion of said bottom profile being disposed generally outside said triangle.

38. A pool cleaner for travel along submerged surfaces of a swimming pool, comprising:

a drive train including a frame, a drive shaft rotatably supported on said frame, and a water turbine rotatably supported on said frame and drivingly coupled to said drive shaft;

a plurality of cleaner wheels;

axle means coupled between said drive shaft and said wheels for supporting said wheels in driving relation with respect to said drive shaft;

a cleaner housing including a generally upwardly open and shell-shaped housing base having an open and generally vertically oriented suction mast joined thereto, and a pair of generally shell-shaped cowlings adapted to fit matingly to define a generally downwardly open housing portion shaped to fit about said suction mast and in conformance with said housing base;

means for defining a pressure manifold within said housing and including a first jet nozzle in communication with said manifold and opening upwardly within said suction mast and a second jet nozzle in communication with said manifold and opening in a direction for discharging a water flow into driving relation with said water turbine;

an open supply mast having a downstream end coupled with said pressure manifold and an upstream end outside said housing for coupling said manifold to a supply of water under pressure;

means for securing said drive train in a position encased within said housing with said axle means projecting through relatively small openings defined by said housing and said wheels disposed outside said housing; and a thrust jet mounted on said housing at a position generally above the rotational axes of said wheels and opening in a direction generally opposite the direction of cleaner movement, a sweep hose jet mounted on said housing at a position below said thrust jet, a flexible sweep hose coupled to said sweep hose jet and extending in a direction for trailing said housing during cleaner movement, and means for coupling said thrust jet and said sweep hose jet to said pressure manifold for communication with the supply of water under pressure supplied to said pressure manifold, said thrust jet providing a forwardly directed reaction force above the rotational axes of said wheels to assist in maintaining traction engagement between said wheels and submerged pool surfaces.

39. A pool cleaner for travel along submerged surfaces of a swimming pool, comprising:

a drive train including a frame, a drive shaft rotatably supported on said frame, and a water turbine rotatably supported on said frame and drivingly coupled to said drive shaft;

a plurality of cleaner wheels;

axle means coupled between said drive shaft and said wheels for supporting said wheels in driven rotation with respect to said drive shaft;

a cleaner housing including a generally upwardly open and shell-shaped housing base having an open and generally vertically oriented suction mast joined thereto, and a pair of generally shell-shaped cowlings adapted to fit matingly to define a generally downwardly open housing portion shaped to fit about said suction mast and in conformance with said housing base;

means for defining a pressure manifold within said housing and including a first jet nozzle in communication with said manifold and opening upwardly within said suction mast and a second jet nozzle in communication with said manifold and opening in a direction for discharging a water flow into driving relation with said water turbine;

an open supply mast having a downstream end coupled with said pressure manifold and an upstream end outside said housing for coupling said manifold to a supply of water under pressure;

means for securing said drive train in a position encased within said housing with said axle means projecting through relatively small openings defined by said housing and said wheels disposed outside said housing; and a back up valve assembly mounted within said housing generally between said water supply mast and said drive train, said back up valve assembly including a back up jet port opening generally downwardly to the exterior of said housing, and an hydraulic timer driven by said flow of water under pressure and including means for periodically diverting said flow of water under pressure from said pressure manifold through said back up port for a short time interval to create a reaction force driving said cleaner in a generally upward direction.

40. A pool cleaner for travel along submerged surfaces of a swimming pool to collect and dislodge debris, comprising:

a cleaner housing;

a drive assembly including a plurality of wheels positioned outside said housing for supporting and driving the cleaner and a drive train substantially within said housing for rotatably driving at least one of said wheels in a direction for forward cleaner movement;

a vacuum system including a collection bag, a suction mast mounted on said housing and defining an open flow path extending from a lower end opening generally beneath said housing into said collection bag, and means for drawing pool water and debris from within the pool into said bag;

a thrust jet mounted on said housing at a position generally above the rotational axes of said wheels and opening generally in a rearward direction relative to the forward direction of cleaner movement;

a sweep hose jet mounted on said housing at a position below said thrust jet;

a flexible sweep hose coupled to said sweep hose jet and extending generally in a rearward direction from said housing; and means for supplying pressurized water for flow through said thrust jet and said sweep hose jet, said thrust jet providing a forwardly directed reaction force above the rotational axes of said wheels to assist in maintaining traction engagement between said wheels and submerged pool surfaces.

41. The pool cleaner of claim 40 wherein said housing comprises a generally upwardly open and shell-shaped housing base including means for seated reception of said drive train, said suction mast being joined with said housing base and projecting upwardly therefrom, said housing further including a pair of mating and generally shell-shaped cowlings together defining a generally downwardly open housing portion sized to fit with close tolerance about said suction mast and in conformance with said housing base to encase said drive train, and further including means for securing said housing base, said suction mast, and said cowlings with respect to each other.

42. A pool cleaner for travel along submerged surfaces of a swimming pool to collect and dislodge debris, comprising:

a cleaner housing;

a drive assembly including a plurality of wheels positioned outside said housing for supporting and driving the cleaner and a drive train substantially within said housing for rotatably driving at least one of said wheels in a direction for forward cleaner movement;

a vacuum system including a collection bag, a suction mast mounted on said housing and defining an open flow path extending from a lower end opening generally beneath said housing into said collection bag, and means for drawing pool water and debris from within the pool into said bag;

a thrust jet mounted on said housing at a position generally above the rotational axes of said wheels and opening generally in a rearward direction relative to the forward direction of cleaner movement;

a sweep hose jet mounted on said housing at a position below said thrust jet;

a flexible sweep hose coupled to said sweep hose jet and extending generally in a rearward direction from said housing; and means for supplying pressurized water for flow through said thrust jet and said sweep hose jet;

said housing comprising a generally upwardly open and shell-shaped housing base including means for seated reception of said drive train, said suction mast being joined with said housing base and projecting upwardly therefrom, said housing further including a pair of mating and generally shell-shaped cowlings together defining a generally downwardly open housing portion sized to fit with close tolerance about said suction mast and in conformance with said housing base to encase said drive train, and further including means for securing said housing base, said suction mast, and said cowlings with respect to each other; and said housing base further including a platform mounted within said housing base and cooperating therewith to define a pressure manifold, and means for coupling a supply of water under pressure to said manifold, said water drawing means comprising at least one jet nozzle opening from said manifold generally in an upward direction within said suction mast, a portion of said platform cooperating with said housing base to form said supply means for said thrust jet and said sweep hose jet.

43. A pool cleaner for travel along submerged surfaces of a swimming pool to collect and dislodge debris, comprising:

a cleaner housing;

an hydraulic drive assembly including a plurality of wheels for supporting and driving the cleaner, and an hydraulically powered drive train substantially within said housing for rotatably driving at least one of said wheels in a direction for forward cleaner movement;

a vacuum system including a collection bag and means for drawing pool water and debris from within the pool into said bag;

a water supply mast mounted within said housing for guiding a driving water flow from outside said housing into driving relation with said drive train;

means for supplying a flow of water under pressure to said water supply mast; and a back up valve assembly mounted within said housing generally between said water supply mast and said drive train, said back up valve assembly including a back up jet port opening generally downwardly to the exterior of said housing, and an hydraulic timer driven by said flow of water under pressure and including means for periodically diverting said flow of water under pressure from said drive train for flow substantially through said back up port for a short time interval to create a reaction force driving the cleaner in a generally upward direction.

44. The pool cleaner of claim 43 wherein said hydraulic timer comprises a water wheel rotatably driven by the flow of water through said supply mast, a back up valve plate for alternatively directing said flow to said drive train and to said back up jet port, and a reduction gear train coupled between said water wheel and said valve plate.

45. The pool cleaner of claim 44 wherein said back up valve assembly includes a primary flow tube coupled between said supply mast and said drive train, means forming a bleed port for diverting a portion of the supply of water flowing through said supply mast in a direction generally perpendicular to the general direction of water flow through said primary flow tube into driving association with said water wheel, said back up valve plate being driven by said reduction gear train.

46. The pool cleaner of claim 44 wherein said valve plate comprises a rotatably mounted Geneva wheel having a plurality of radially outwardly open slots formed therein and at least one radially outwardly projecting valve segment, and said reduction gear train includes a rotatably mounted drive plate having a plurality of drive pins projecting axially therefrom at positions spaced from the rotational axis of said drive plate for reception into said Geneva wheel slots for rotatably driving said Geneva wheel.

47. The pool cleaner of claim 43 including means for disabling said hydraulic timer.

48. A pool cleaner for travel along submerged surfaces of a swimming pool to collect and dislodge debris, comprising:

a cleaner housing;

an hydraulic drive assembly including a plurality of wheels for supporting and driving the cleaner, and an hydraulically powered drive train substantially within said housing for rotatably driving at least one of said wheels in a direction for forward cleaner movement;

a vacuum system including a collection bag and means for drawing pool water and debris from within the pool into said bag;

a water supply mast mounted within said housing for guiding a driving water flow from outside said housing into driving relation with said drive train;

means for supplying a flow of water under pressure to said water supply mast; and a back up valve assembly mounted on said housing and including a back up port having a generally downward component of direction opening to the exterior of said housing, and an hydraulic timer responsive to said flow of water under pressure and including valve means for periodically diverting said flow for a short time interval from said drive train substantially to said back up port to create a reaction force driving the cleaner with a generally upward component of direction.

49. A pool cleaner for travel along submerged surfaces of a swimming pool to collect and dislodge debris, comprising:

a cleaner housing;

an hydraulic drive assembly including a plurality of wheels for supporting and driving the cleaner and turbine means within said housing for hydraulically driving at least one of said wheels;

an hydraulic vacuum system including a collection bag, a suction mast mounted on said housing and defining an open flow path between said bag and a pool surface adjacent said housing, and means for directing a flow of water through said suction mast for inducing a flow of pool water and debris within the pool into said bag;

means forming a pressure manifold comprising a pressure plenum within said housing in a position generally surrounding said suction mast and including a first nozzle in flow communication with said hydraulic drive assembly to drive said turbine means and a second nozzle in flow communication with said suction mast, said first and second nozzles having upstream ends opening substantially directly into said plenum; and means for coupling a supply of water under pressure to said pressure manifold whereby water is supplied to the upstream ends of said first and second nozzles at substantially the same pressure.

50. The pool cleaner of claim 49 further including a thrust jet mounted on said housing at a position generally above the rotational axes of said wheels and opening in a direction generally opposite the direction of cleaner movement, a sweep hose jet mounted on said housing at a position below said thrust jet, a flexible sweep hose coupled to said sweep hose jet and extending in a direction for trailing said housing during cleaner movement, and means for coupling said thrust jet and said sweep hose jet to said pressure manifold for communication with the supply of water under pressure supplied to said pressure manifold.

51. A pool cleaner for travel along submerged surfaces of a swimming pool to collect and dislodge debris, comprising:

a cleaner housing;

a vacuum system including a collection bag and means for drawing a flow of pool water and debris from within the pool into said bag for collection; and a drive assembly including a plurality of wheels positioned outside said housing for supporting and driving the cleaner and a drive train substantially encased within said housing for rotatably driving a driven member supported by an inner bearing within said housing for rotation about a nonrotational shaft, said driven member including a drive hub projecting through an opening in said housing;

at least one of said wheels being rotatably supported with respect to said housing by an outer bearing mounted on said at least one wheel outside said housing for rotation about said nonrotational shaft, said at least one wheel including a driven hub in driven engagement with said drive hub.

52. A pool cleaner for travel along submerged surfaces of a swimming pool to collect and dislodge debris, comprising:

a cleaner housing a drive assembly including a plurality of wheels for supporting and driving said housing and means within said housing for rotatably driving at least one of said wheels in a direction for forward cleaner movement, said plurality of wheels including first and second wheels at one side of said housing and a third wheel at an opposite side of said housing with the rotational centers of said wheels defining apexes of a triangle;

an hydraulic vacuum system including a suction mast mounted on said housing and defining an open flow path extending from generally centrally beneath said housing to a position generally above said housing, a collection bag for removable mounting onto said suction mast at a position generally above said housing, and means for inducing a flow of water from the pool and debris from within the pool through said suction mast into said bag;

said housing being formed with a bottom profile defined by a generally transversely extending and generally upwardly directed shoulder at a position generally to the rear of said suction mast and said triangle and in relatively closely spaced relation to said suction mast, said bottom profile being defined further by a rear housing portion extending generally rearwardly from the upper extent of said shoulder with a substantially increased spacing from the adjacent underlying pool surface relative to the spacing between said suction mast beneath said housing and the adjacent pool surface.

53. A pool cleaner for travel along submerged surfaces of a swimming pool to collect and dislodge debris, said pool cleaner being for connection to a flexible supply hose, said pool cleaner comprising:

a cleaner housing formed from a plurality of generally shell-shaped housing portions adapted for assembly to define a substantially enclosed housing interior, a drive assembly including a plurality of wheels for supporting and driving the cleaner and means within said housing for rotatably driving at least one of said wheels;

a vacuum system including a collection bag and means for drawing pool water and debris from within the pool into said bag;

at least one of said drive means and said drawing means being operated in response to a supply of water under pressure coupled thereto; and a supply mast removably mounted on said housing and extending from a position outside said housing into the housing interior, said supply mast having an upper end for connection to the flexible supply hose and defining an open flow path for coupling the supply of water under pressure to said at least one of said drive means and said drawing means, said supply mast including an upper end portion outside said housing angled upwardly and rearwardly in a direction away from the direction of cleaner movement to substantially minimize dragging effects of the supply hose during operation of the cleaner in relatively shallow water.

54. The pool cleaner of claim 53 wherein said supply mast upper end is angled rearwardly at an angle of about 15 degrees.

55. The pool cleaner of claim 53 wherein said vacuum system includes a suction mast on said housing and defining an open flow path for passage of pool water and debris into said bag, means for removably and directly attaching said supply mast onto said suction mast, and means for nonrigidly coupling a downwstream end of said supply mast relative to said at least one of said drive means and said drawing means.

56. A pool cleaner for travel along submerged surfaces of a swimming pool to collect and dislodge debris, comprising:

a drive assembly including, as a preassembled unit, a plurality of wheels for supporting and driving the cleaner and a drive train for rotatably driving at least one of said wheels;

a cleaner housing formed from a generally upwardly open and generally shell-shaped housing base including means for seated reception of said drive assembly as a unit with said wheels disposed outside said housing base, a central suction mast on said housing base defining an open flow path from beneath said housing base to above said housing, and a pair of upper mating cowlings together defining a generally downwardly open shell-shaped housing portion shaped to fit about said suction mast and over said housing base in conformance therewith to enclose said drive train within said housing, said drive assembly being removable from said housing as a unit;

means for connecting said housing base and said cowlings with respect to each other; and means for drawing a flow of pool water and debris from within the pool generally upwardly through said suction mast.

57. A pool cleaner for travel along submerged surfaces of a swimming pool to collect and dislodge debris, comprising:

a cleaner housing;

a drive assembly including a plurality of wheels for supporting and driving the cleaner and means within said housing for rotatably driving at least one of said wheels;

a vacuum system including a suction mast mounted on said housing and defining an open flow path extending from an inlet end adjacent a surface of the pool and an outlet end disposed outside said housing, and means for drawing a flow of pool water and debris from within the pool through said suction mast toward said outlet end, said suction mast having formed therein a pair of generally opposed openings near said outlet end;

a debris collection bag having an open end; and means mounted on said collection bag at said open end for removable attachment of said collection bag to said suction mast, said attachment means including a pair of opposed latch clips for depression toward one another and oriented to extend into said suction mast in alignment with said mast openings, said latch clips having outwardly projecting tabs for releasable locked reception into said mast openings to secure said bag onto said suction mast.

58. The pool cleaner of claim 57 wherein said bag mounting means includes a mounting ring carrying said latch clips.

59. The pool cleaner of claim 57 further including a locking collar receivable about said mounting ring with said bag open end trapped therebetween.

60. The pool cleaner of claim 59 wherein said mounting ring and said suction mast include cooperating generally flush-bearing peripheral surfaces when said mounting ring is mounted on said mast.

61. A pool cleaner for travel along submerged surfaces of a swimming pool, comprising:

a drive train including a frame, a drive shaft rotatably supported on said frame, and a water turbine rotatably supported on said frame and drivingly coupled to said drive shaft;

a plurality of cleaner wheels;

axle means coupled between said drive shaft and said wheels for supporting said wheels in driven relation with respect to said drive shaft;

a cleaner housing including a generally upwardly open and shell-shaped housing base having an open and generally vertically oriented suction mast joined thereto, and a pair of generally shell-shaped cowlings adapted to fit matingly to define a generally downwardly open housing portion shaped to fit about said suction mast and in conformance with said housing base;

means for defining a pressure manifold within said housing and including a first jet nozzle in communication with said manifold and opening upwardly within said suction mast and a plurality of second jet nozzles in communication with said manifold and opening in a direction for discharging a respective plurality of water flows into driving relation with said water turbin at different positions spaced about the periphery of said water turbine;

an open supply mast having a downstream end coupled with said pressure manifold and an upstream end outside said housing for coupling said manifold to a supply of water under pressure; and means for securing said drive train in a position encased within said housing with said axle means projecting through relatively small openings defined by said housing and said wheels disposed outside said housing.

* * * * *